US008477087B2

(12) United States Patent
Yamamoto et al.

(10) Patent No.: US 8,477,087 B2
(45) Date of Patent: Jul. 2, 2013

(54) PANEL AND DRIVE CONTROL METHOD

(75) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 967 days.

(21) Appl. No.: 12/453,908

(22) Filed: May 27, 2009

(65) Prior Publication Data

US 2009/0315812 A1 Dec. 24, 2009

(30) Foreign Application Priority Data

Jun. 18, 2008 (JP) ..... 2008-159364

(51) Int. Cl.
*G09G 3/30* (2006.01)

(52) U.S. Cl.
USPC ..... 345/76; 345/77; 345/78; 345/79; 345/80; 345/81

(58) Field of Classification Search
USPC . 345/76–84, 204–215, 690–699; 324/760.01; 313/505; 434/433
See application file for complete search history.

(56) References Cited

U.S. PATENT DOCUMENTS

| | | | | |
|---|---|---|---|---|
| 5,261,010 | A * | 11/1993 | Lo et al. | 382/216 |
| 7,054,474 | B1 * | 5/2006 | Krieger | 382/128 |
| 7,525,522 | B2 * | 4/2009 | Iida et al. | 345/76 |
| 7,583,261 | B2 * | 9/2009 | Shirasaki et al. | 345/212 |
| 7,663,615 | B2 * | 2/2010 | Shirasaki et al. | 345/204 |
| 7,696,773 | B2 * | 4/2010 | Levey | 324/760.01 |
| 7,898,509 | B2 * | 3/2011 | Iida et al. | 345/76 |
| 7,907,105 | B2 * | 3/2011 | Shirasaki et al. | 345/77 |
| 7,986,285 | B2 * | 7/2011 | Iida et al. | 345/76 |
| 8,237,639 | B2 * | 8/2012 | Yamashita et al. | 345/82 |
| 8,269,755 | B2 * | 9/2012 | Minami | 345/208 |
| 8,378,930 | B2 * | 2/2013 | Asano | 345/76 |
| 8,400,442 | B2 * | 3/2013 | Yamashita et al. | 345/212 |
| 2004/0160395 | A1 * | 8/2004 | Yoshida | 345/82 |
| 2006/0061560 | A1 * | 3/2006 | Yamashita et al. | 345/204 |
| 2006/0125740 | A1 * | 6/2006 | Shirasaki et al. | 345/77 |
| 2006/0250534 | A1 * | 11/2006 | Kutscher et al. | 349/41 |
| 2007/0159416 | A1 * | 7/2007 | Whight | 345/76 |
| 2007/0257946 | A1 * | 11/2007 | Miller et al. | 345/694 |
| 2007/0273621 | A1 * | 11/2007 | Yamashita et al. | 345/76 |
| 2008/0036708 | A1 * | 2/2008 | Shirasaki et al. | 345/76 |

(Continued)

FOREIGN PATENT DOCUMENTS

| | | |
|---|---|---|
| JP | 2001-060076 A | 3/2001 |
| JP | 2003-255856 | 9/2003 |

(Continued)

OTHER PUBLICATIONS

Japanese Office Action issued Jun. 1, 2010 for corresponding Japanese Application No. 2008-159364.

*Primary Examiner* — Prabodh M Dharia
(74) *Attorney, Agent, or Firm* — Rader, Fishman & Grauer PLLC

(57) ABSTRACT

A common power line shared by all the pixels allows threshold correction to be performed simultaneously on all the pixels. Video signal lines are set to a second reference potential higher than a reference potential, followed by multi-step threshold correction and video signal writing which are performed in a line sequential manner. Performing the threshold correction immediately before the video signal writing ensures shorter time from the threshold correction to the video signal writing. This suppresses leak currents, providing improved image quality.

12 Claims, 18 Drawing Sheets

U.S. PATENT DOCUMENTS

| | | | | |
|---|---|---|---|---|
| 2008/0049007 | A1* | 2/2008 | Iida et al. | 345/211 |
| 2008/0111774 | A1* | 5/2008 | Iida et al. | 345/76 |
| 2008/0111812 | A1* | 5/2008 | Shirasaki et al. | 345/212 |
| 2008/0150843 | A1* | 6/2008 | Yamamoto et al. | 345/76 |
| 2008/0150933 | A1* | 6/2008 | Toyomura et al. | 345/214 |
| 2008/0158110 | A1* | 7/2008 | Iida et al. | 345/76 |
| 2008/0225023 | A1* | 9/2008 | Shimizu et al. | 345/204 |
| 2008/0225027 | A1* | 9/2008 | Toyomura et al. | 345/204 |
| 2008/0231560 | A1* | 9/2008 | Yamashita et al. | 345/76 |
| 2008/0231625 | A1* | 9/2008 | Minami et al. | 345/212 |
| 2008/0284774 | A1* | 11/2008 | Yamashita et al. | 345/212 |
| 2008/0291138 | A1* | 11/2008 | Yamashita et al. | 345/76 |
| 2008/0291182 | A1* | 11/2008 | Yamashita et al. | 345/204 |
| 2008/0297449 | A1* | 12/2008 | Yamashita et al. | 345/76 |
| 2009/0122047 | A1* | 5/2009 | Yamamoto et al. | 345/211 |
| 2009/0244050 | A1* | 10/2009 | Yamamoto et al. | 345/212 |
| 2009/0262258 | A1* | 10/2009 | Taneda et al. | 348/739 |
| 2009/0278771 | A1* | 11/2009 | Yamamoto et al. | 345/76 |
| 2009/0284451 | A1* | 11/2009 | Yamamoto et al. | 345/77 |

FOREIGN PATENT DOCUMENTS

| | | | |
|---|---|---|---|
| JP | 2003-271095 | | 9/2003 |
| JP | 2004-029791 | | 1/2004 |
| JP | 2004-093682 | | 3/2004 |
| JP | 2004-133240 | | 4/2004 |
| JP | 2005-258326 | A | 9/2005 |
| JP | 2005-326793 | A | 11/2005 |
| JP | 2006-133731 | A | 5/2006 |
| JP | 2006-330223 | A | 12/2006 |
| JP | 2007-068020 | * | 3/2007 |
| JP | 2007-133282 | A | 5/2007 |
| JP | 2007-206273 | A | 8/2007 |
| JP | 2007-310311 | A | 11/2007 |
| JP | 2008-033193 | A | 2/2008 |
| JP | 2008-287139 | A | 11/2008 |
| JP | 2009-139928 | A | 6/2009 |
| JP | 2009-237041 | A | 10/2009 |
| JP | 2009-244665 | A | 10/2009 |
| JP | 2009-244666 | A | 10/2009 |

* cited by examiner

PANEL AND DRIVE CONTROL METHOD

BACKGROUND OF THE INVENTION

1. Field of the Invention

The present invention relates to a panel and drive control method, and more particularly to a panel and drive control method for providing reduced cost.

2. Description of the Related Art

Recent years have seen the brisk development of self-luminous panels (EL panels) using organic EL (Electro Luminescent) devices as their light-emitting elements. Organic EL devices rely on light emission from an organic thin film when the film is applied with an electric field. These devices operate on a small applied voltage of 10V or less, making these devices low in power consumption. Further, these devices are self-luminous and emit light by themselves, eliminating the need for illuminating members in the panel and permitting easy reduction of weight and thickness of the panel. Further, these devices offer extremely high response speed or approximately several μseconds, thus producing no afterimage during display of a moving image.

Among other flat self-luminous panels using organic EL devices, the development of active matrix panels having a thin film transistor integrated in each pixel as a driving element is going on at a brisk pace. Active matrix flat self-luminous panels are disclosed, for example, in Japanese Patent Laid-Open Nos. 2003-255856, 2003-271095, 2004-133240, 2004-029791 and 2004-093682.

SUMMARY OF THE INVENTION

However, flat self-luminous panels using organic EL devices are demanded to be even lower in cost than liquid crystal displays (LCD) which have found widespread use.

The present embodiment has been made in light of the foregoing, and it is therefore desired the present embodiment to provide reduced cost.

A panel according to an embodiment of the present invention has pixel circuits arranged in a matrix form. Each of the pixel circuits includes a light-emitting element, sampling transistor, drive transistor and holding capacitor. The light-emitting element emits light according to a drive current. The sampling transistor samples a video signal. The drive transistor supplies the drive current to the light-emitting element. The holding capacitor holds a given potential. The panel includes power supply means adapted to control a source voltage, supplied to the pixel circuits, simultaneously for the pixel circuits in two or more rows. Threshold correction preparation and first threshold correction are performed simultaneously on all the pixel circuits in two or more rows in units of which the pixel circuits are controlled by the power supply means. Then, second threshold correction is performed on the pixel circuits one row at a time once or more times in a line sequential manner.

The panel further includes video signal supply means adapted to supply a signal potential, associated with a video signal, to the pixel circuits. The video signal supply means can supply, during the second threshold correction, a higher potential than a reference potential supplied to the pixel circuits during the first threshold correction.

The panel further includes video signal supply means adapted to supply a signal potential, associated with a video signal, to the pixel circuits. The video signal supply means can supply, for a predetermined period of time after the first threshold correction, a lower potential than a reference potential supplied to the pixel circuits during the first threshold correction.

The panel further includes scan control means adapted to turn the sampling transistors of the pixel circuits on or off. The light emission period of the light-emitting elements can be controlled by turning the sampling transistors of the pixel circuits on or off.

A drive control method according to an embodiment of the present invention is a drive control method of a panel which has pixel circuits arranged in a matrix form. Each of the pixel circuits includes a light-emitting element, sampling transistor, drive transistor and holding capacitor. The light-emitting element emits light according to a drive current. The sampling transistor samples a video signal. The drive transistor supplies the drive current to the light-emitting element. The holding capacitor holds a given potential. The panel includes power supply means adapted to control a source voltage, supplied to the pixel circuits, simultaneously for the pixel circuits in two or more rows. The drive control method includes a step of performing threshold correction preparation and first threshold correction simultaneously on all the pixel circuits in two or more rows, and then performing second threshold correction on the pixel circuits one row at a time once or more times in a line sequential manner.

According to an embodiment of the present invention, threshold correction preparation and first threshold correction are performed simultaneously on pixel circuits in two or more rows. Then, second threshold correction is performed on the pixel circuits one row at a time once or more times in a line sequential manner.

An embodiment of the present invention provides reduced cost of EL panels.

DETAILED DESCRIPTION OF THE PREFERRED EMBODIMENTS

Figure 1:
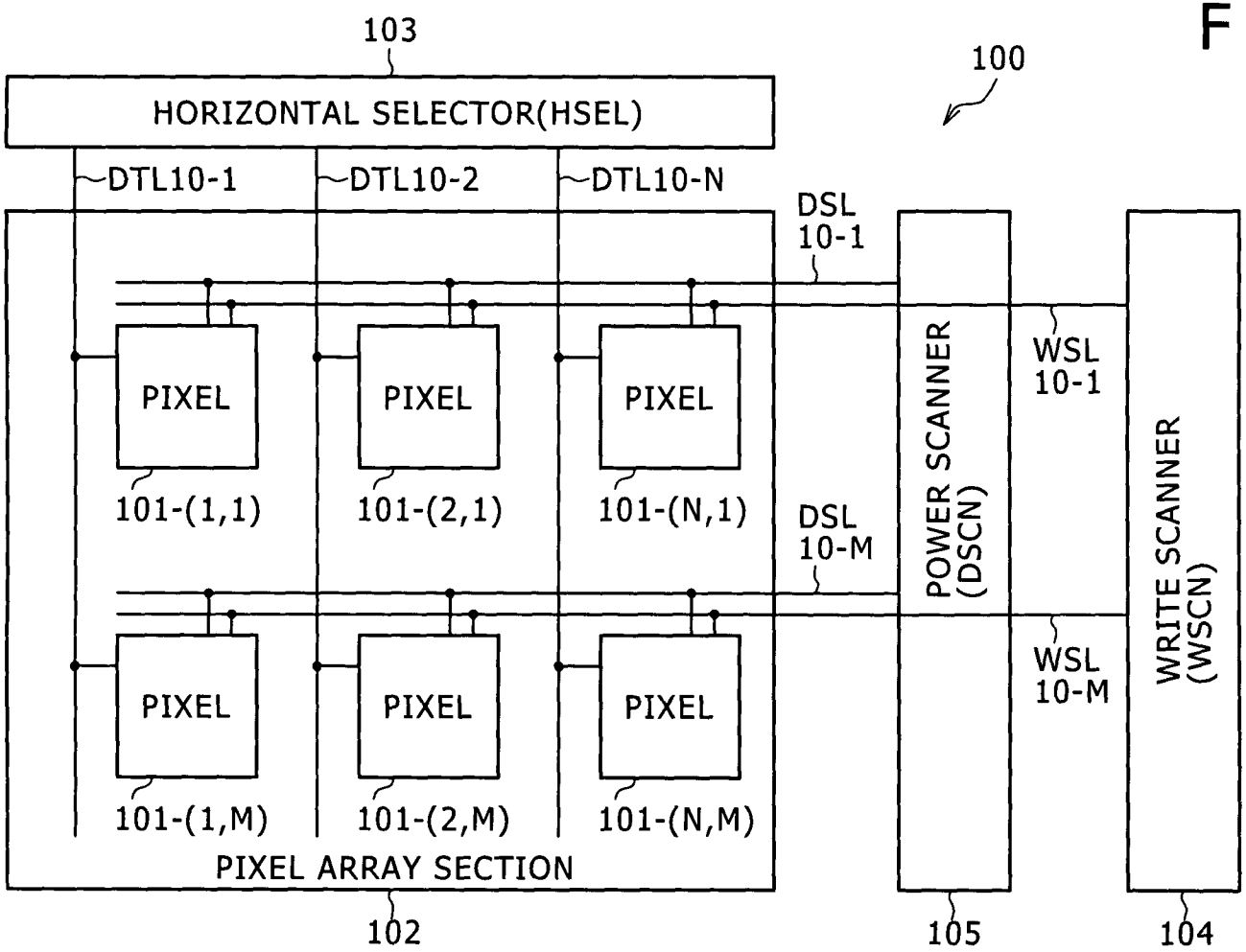
FIG. 1 is a block diagram illustrating a basic configuration example of an EL panel.

The preferred embodiments of the present invention will be described below. The correspondence between the constituent elements of the present invention and the embodiments disclosed in the specification or drawings is as follows. This description is intended to confirm that the embodiments supporting the invention are disclosed in the specification or drawings. Therefore, even if any embodiment disclosed in the specification or drawings is not stated herein as relating to a constituent element as defined by an appended claim, it does not means that the embodiment does not relate to the constituent element. On the contrary, even if an embodiment is disclosed herein as relating to a constituent element as defined by an appended claim, it does not mean that the embodiment does not relate to any other constituent element.

A panel according to an embodiment of the present invention (e.g., EL panel 200 in FIG. 16) has pixel circuits (e.g., pixels 101*c* in FIG. 5) arranged in a matrix form. Each of the pixel circuits includes a light-emitting element (e.g., light-emitting element 34 in FIG. 5), sampling transistor (e.g., sampling transistor 31 in FIG. 5), drive transistor (e.g., drive transistor 32 in FIG. 5) and holding capacitor (e.g., holding capacitor 33 in FIG. 5). The light-emitting element emits light according to a drive current. The sampling transistor samples a video signal. The drive transistor supplies the drive current to the light-emitting element. The holding capacitor holds a given potential. The panel includes a power supply section (e.g., power supply section 211 in FIG. 16) adapted to control a source voltage, supplied to the pixel circuits, simultaneously for all the pixel circuits in two or more rows. The power supply section configured to perform threshold correction preparation and first threshold correction on the pixel circuits in two or more rows in units of which the pixel circuits are controlled by the power supply section. Then, the same section configured to perform second threshold correction on the pixel circuits one row at a time once or more times in a line sequential manner.

The panel further includes a video signal supply section (e.g., horizontal selector 103 in FIG. 16) adapted to supply a signal potential, associated with a video signal, to the pixel circuits. The video signal supply section can supply, during the second threshold correction, a higher potential (e.g., reference potential Vofs2 in FIG. 18) than a reference potential (e.g., reference potential Vofs in FIG. 18) supplied to the pixel circuits during the first threshold correction.

The panel further includes a video signal supply section (e.g., write scanner 104 in FIG. 16) adapted to supply a signal potential, associated with a video signal, to the pixel circuits. The video signal supply section can supply, for a predetermined period of time after the first threshold correction, a lower potential (e.g., third reference potential Vini in FIG. 20) than the reference potential (e.g., reference potential Vofs in FIG. 20) supplied to the pixel circuits during the first threshold correction.

The preferred embodiments of the present invention will be described below with reference to the accompanying drawings.

In order to facilitate the understanding of the embodiment of the present invention and clarify the background thereof, a description will be given first of the basic configuration and operation of the panel using organic EL devices (hereinafter referred to as the EL panel) with reference to FIGS. 1 to 15.

FIG. 1 is a block diagram illustrating a basic configuration example of the EL panel.

An EL panel 100 shown in FIG. 1 includes a pixel array section 102 and a drive section adapted to drive the pixel array section 102, namely, a horizontal selector (HSEL) 103, write scanner (WSCN) 104 and power scanner (DSCN) 105. The pixel array section 102 has N by M pixels (pixel circuits) 101-(1,1) to 101-(N,M) arranged in a matrix form.

The EL panel 100 also includes M scan lines WSL10-1 to 10-M, M power lines DSL10-1 to 10-M and N video signal lines DTL10-1 to 10-N.

It should be noted that if, in the following description, there is no particular need to distinguish between the scan lines WSL10-1 to 10-M, video signal lines DTL10-1 to 10-N, pixels 101-(1,1) to 101-(N,M) or power lines DSL10-1 to 10-M, these lines or pixels will be simply referred to as the scan line WSL10, video signal lines DTL10, pixels 101 or power lines DSL10.

Of the pixels 101-(1,1) to 101-(N,M), the pixels 101-(1,1) to 101-(N,1) in the first row are connected to the write scanner 104 and power scanner 105 respectively with the scan line WSL10-1 and power line DSL10-1. Further, of the pixels 101-(1,1) to 101-(N,M), the pixels 101-(1,M) to 101-(N,M) in the Mth row are connected to the write scanner 104 and power scanner 105 respectively with the scan line WSL10-M and power line DSL10-M. This holds true for all other pixels 101 among the pixels 101-(1,1) to 101-(N,M) arranged in the row direction.

Still further, of the pixels 101-(1,1) to 101-(N,M), the pixels 101-(1,1) to 101-(1,M) in the first column are connected to the horizontal selector 103 with the video signal line DTL10-1. Of the pixels 101-(1,1) to 101-(N,M), the pixels 101-(N,1) to 101-(N,M) in the Nth column are connected to the horizontal selector 103 with the video signal line DTL10-N. This holds true for all other pixels 101 among the pixels 101-(1,1) to 101-(N,M) arranged in the column direction.

The write scanner 104 supplies a sequential control signal to the scan lines WSL10-1 to 10-M during a horizontal period (1H) to perform a linear sequential scan of the pixels 101 on a row by row basis. The power scanner 105 supplies a source voltage at a first potential (Vcc described later) or second potential (Vss described later) to the power lines DSL10-1 to 10-M in step with the linear sequential scan. The horizontal selector 103 switches between a signal potential Vsig serving as a video signal and the reference potential Vofs and supplies one of the potentials to the video signal lines DTL10-1 to 10-N arranged in columns in step with the linear sequential scan during the horizontal period (1H).

A driver IC (Integrated Circuit) which includes source and gate drivers is added to the EL panel 100 configured as shown in FIG. 1 to make up a panel module. Further, a power circuit, image LSI (Large Scale Integration) and other components are added to make up a display device. A display device incorporating the EL panel 100 is applicable, for example, as a display section of a mobile phone, digital still camera, digital camcorder, television set, printer and other equipment.

Figure 2:
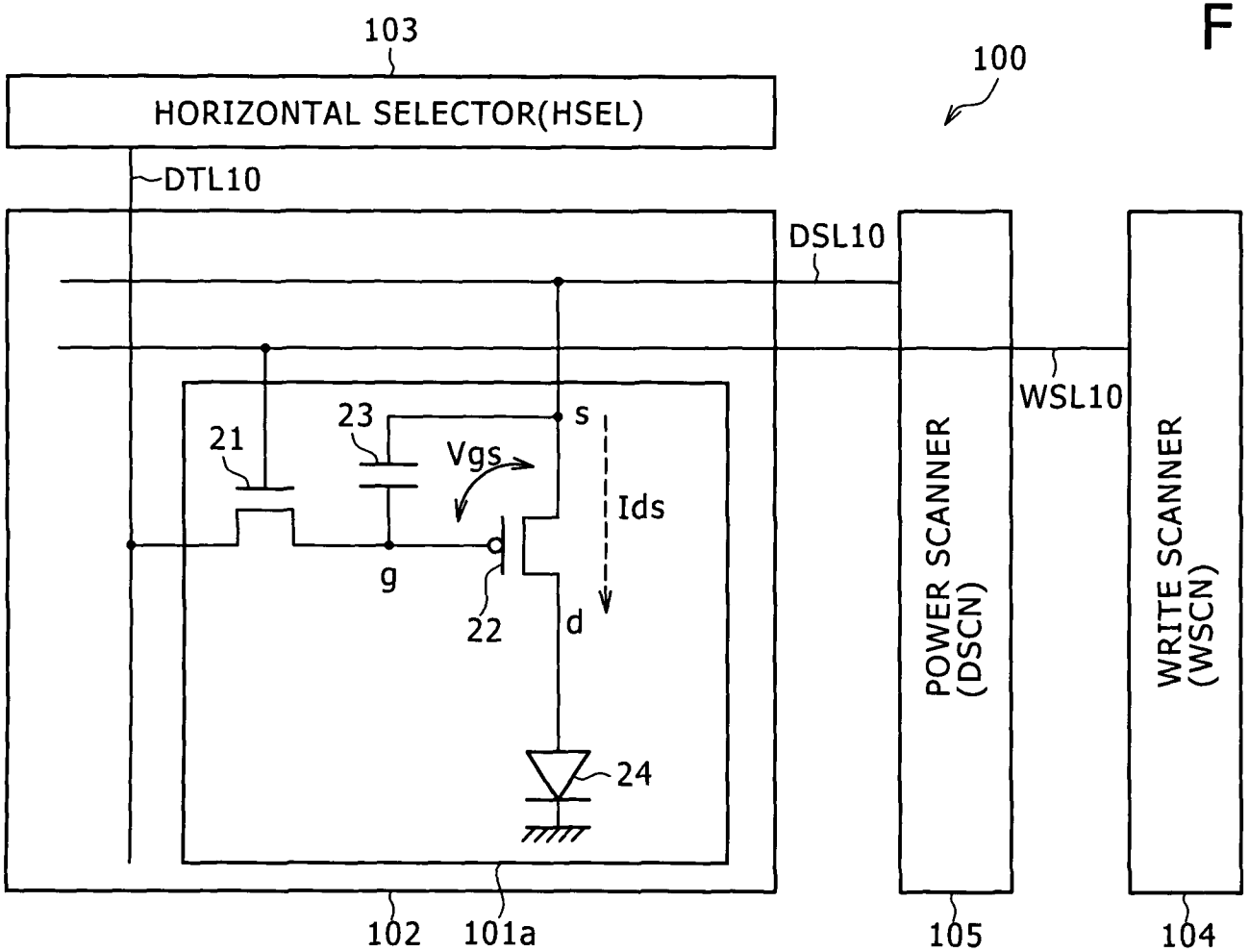
FIG. 2 is a block diagram illustrating a configuration example of an existing pixel.

FIG. 2 is a block diagram illustrating a detailed configuration of the pixel 101 obtained by enlarging one of the N by M pixels 101 in the EL panel 100 shown in FIG. 1.

As is clear from FIG. 1, the scan line WSL10, video signal line DTL10 and power line DSL10 connected to the pixel 101 in FIG. 2 are respectively any one of the scan lines WSL10-(N,M), video signal lines DTL10-(N,M) and power lines DSL10-(N,M) connected to any one of the pixel 101-(N,M) (N=1,2, - - - ,N, M=1,2, - - - ,M).

The configuration of the pixel 101 shown in FIG. 2 has already been in use. The pixel 101 having this configuration will be referred to as a pixel 101*a*.

The pixel 101*a* includes a sampling transistor 21, drive transistor 22, holding capacitor 23 and light-emitting element 24 serving as an organic EL element. Here, the sampling transistor 21 is an N-channel transistor. The drive transistor 22 is a P-channel transistor. The sampling transistor 21 has its gate connected to the scan line WSL10, its drain connected to the video signal line DTL10 and its source connected to a gate g of the drive transistor 22.

The drive transistor 22 has its source s connected to the power line DSL10 and its drain d connected to the anode of the light-emitting element 24. The holding capacitor 23 is connected between the source s and gate g of the drive transistor 22. Further, the light-emitting element 24 has its cathode grounded.

The organic EL element is a current light-emitting element. As a result, color gray levels can be achieved by controlling the current level flowing through the light-emitting element 24. The pixel 101*a* in FIG. 2 controls the current level flowing through the light-emitting element 24 by changing the voltage applied to the gate of the drive transistor 22.

More specifically, the drive transistor 22 is designed to operate in the saturation region at all times because of the connection of its source s to the power line DSL10. As a result, the same transistor 22 functions as a constant current source supplying a current level Ids denoted by equation (1) shown below.

$$Ids = \frac{1}{2}\mu\frac{W}{L}\mathrm{Cox}(Vgs - Vth)^2 \quad (1)$$

In Equation 1, μ represents the mobility, W the gate width, L the gate length, and Cox the capacitance of the gate oxide film per unit area. Further, Vgs represents the voltage between the gate g and source s (gate-to-source voltage) of the drive transistor 22 and Vth the threshold voltage of the same transistor 22. It should be noted that the term "saturation region" refers to the state in which the condition (Vgs−Vth<Vds) is satisfied (Vds is the voltage between the source s and drain d of the drive transistor 22).

Figure 3:
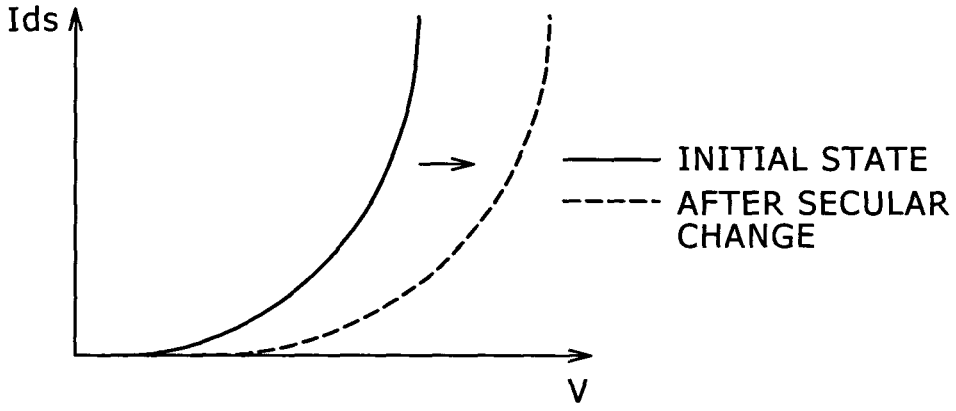
FIG. 3 is a diagram illustrating the I-V characteristic of an organic EL device.

In the pixel 101*a* shown in FIG. 2, the I-V characteristic of the light-emitting element changes as illustrated in FIG. 3 due to deterioration over time, changing the drain voltage of the drive transistor 22. However, if the gate-to-source voltage Vgs of the drive transistor 22 is maintained constant, a constant amount of the current Ids flows through the light-emitting element 24. That is, the current Ids is proportional to the light emission brightness of the light-emitting element. As a result, the brightness of the light-emitting element itself remains constant irrespective of deterioration over time.

However, P-channel transistors cannot be formed with amorphous silicon which allows for transistors to be manufactured less expensively than low-temperature polysilicon. Therefore, if less expensive pixel circuits are desired, such circuits should preferably be formed with N-channel transistors.

Figure 4:
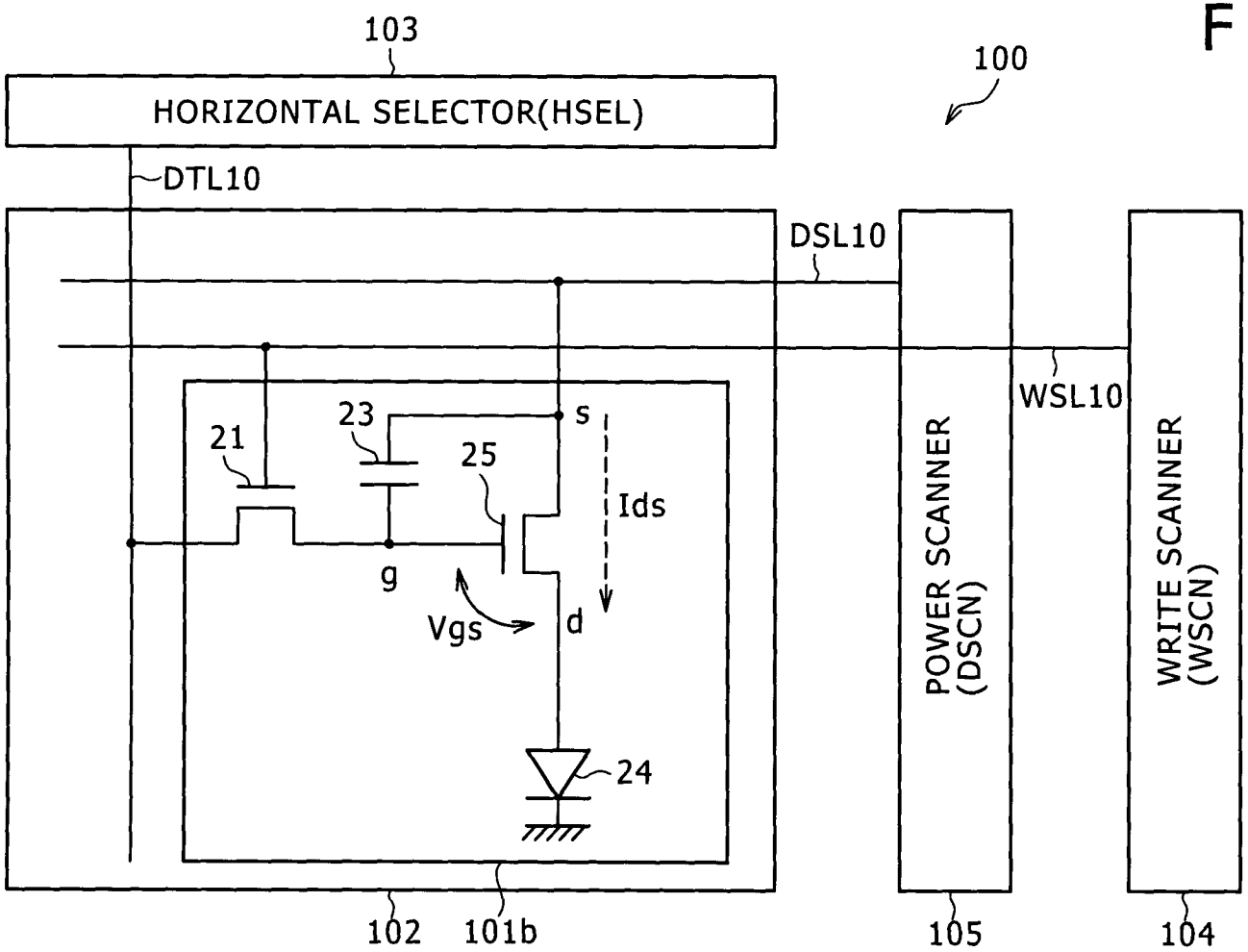
FIG. 4 is a block diagram illustrating a configuration example of an existing pixel.

A possible approach, therefore, would be to replace the P-channel drive transistor 22 with an N-channel drive transistor 25 as shown by a pixel 101*b* in FIG. 4.

That is, the pixel 101*b* shown in FIG. 4 includes an N-channel drive transistor 25 rather than the P-channel drive transistor 22, unlike the pixel 101*a* shown in FIG. 3.

In the configuration of the pixel 101*b* shown in FIG. 4, the source s of the drive transistor 25 is connected to the light-emitting element 24. As a result, the gate-to-source voltage Vgs of the drive transistor 25 changes with the change of the organic EL element over time. This changes the current flowing through the light-emitting element 24, thus changing the light emission brightness. Further, the threshold voltage Vth and mobility u of the drive transistor are different between the different pixels 101*b*. This leads to a variation in the current Ids according to Equation 1 shown in FIG. 4, thus changing the light emission brightness between the different pixels.

Figure 5:
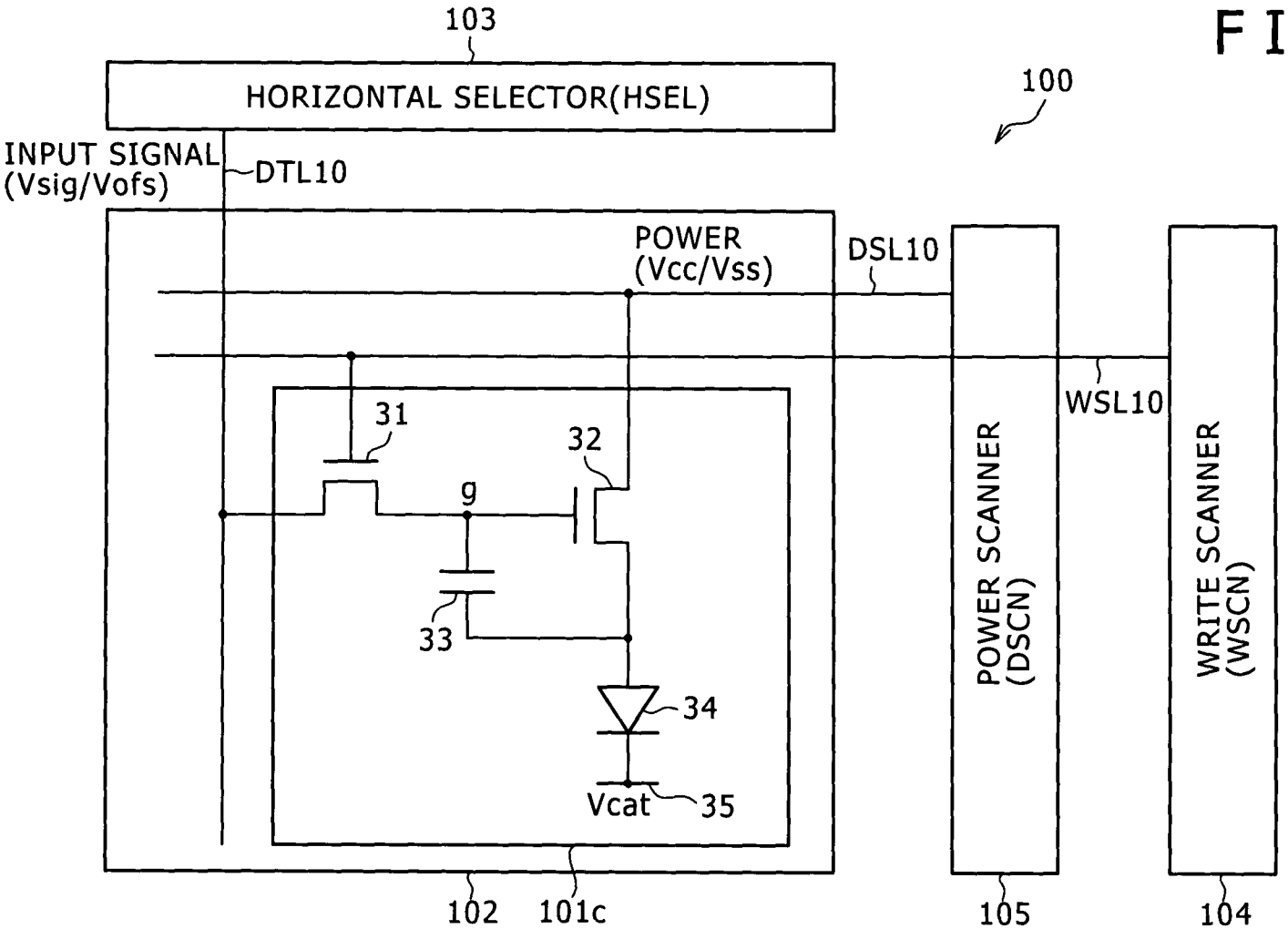
FIG. 5 is a block diagram illustrating a configuration example of a pixel used in the EL panel to which an embodiment of the present invention is applied.

The present applicant proposes the configuration of a pixel 101*c* shown in FIG. 5. The pixel 101*c* is used in the EL panel described later to which an embodiment of the present invention is applied. The pixel 101*c* prevents deterioration of the light-emitting element over time and variation in the characteristics of the drive transistor and includes only a small number of elements.

The pixel 101*c* shown in FIG. 5 includes a sampling transistor 31, drive transistor 32, holding capacitor 33 and light-emitting element 34. The sampling transistor 31 has its gate connected to the scan line WSL10, its drain connected to the video signal line DTL10 and its source connected to the gate g of the drive transistor 32.

The drive transistor 32 has one of its source s and drain d connected to the anode of the light-emitting element 34. The same transistor 32 has the other of its source s and drain d connected to the power line DSL10. The holding capacitor 33 is connected between the gate g of the drive transistor and the anode of the light-emitting element 34. Further, the light-emitting element 34 has its cathode connected to a wiring 35 which is set at a predetermined potential Vcat.

In the pixel 101*c* configured as described above, when the sampling transistor 31 turns on (begins conducting) in response to a control signal supplied from the scan line WSL10, the holding capacitor 33 accumulates and holds the charge supplied from the horizontal selector 103 via the video signal line DTL10. The drive transistor 32 is supplied with a current from the power line DSL10 at the first potential Vcc to pass the drive current Ids, commensurate with the signal potential Vsig held by the holding capacitor 33, to the light-emitting element 34. The pixel 101*c* emits light as a result of the predetermined drive current Ids flowing through the light-emitting element 34.

The pixel 101*c* has a threshold correction function. The term "threshold correction function" refers to the function of causing the holding capacitor 33 to hold a voltage equivalent to the threshold voltage Vth of the drive transistor 32. This function can cancel the impact of the threshold voltage Vth of the drive transistor 32 which would otherwise lead to a variation between the different pixels of the EL panel 100.

Further, the pixel 101*c* has a mobility correction function. The term "mobility correction function" refers to the function of correcting the signal potential Vsig for the mobility u of the drive transistor when the holding capacitor 33 holds the signal potential Vsig.

Still further, the pixel 101*c* has a bootstrapping function. The term "bootstrapping function" refers to the function of changing a gate potential Vg of the drive transistor 32 with change in a source potential Vs of the same transistor 32. This function maintains constant the voltage Vgs between the gate g and source s of the drive transistor 32.

Figure 14:
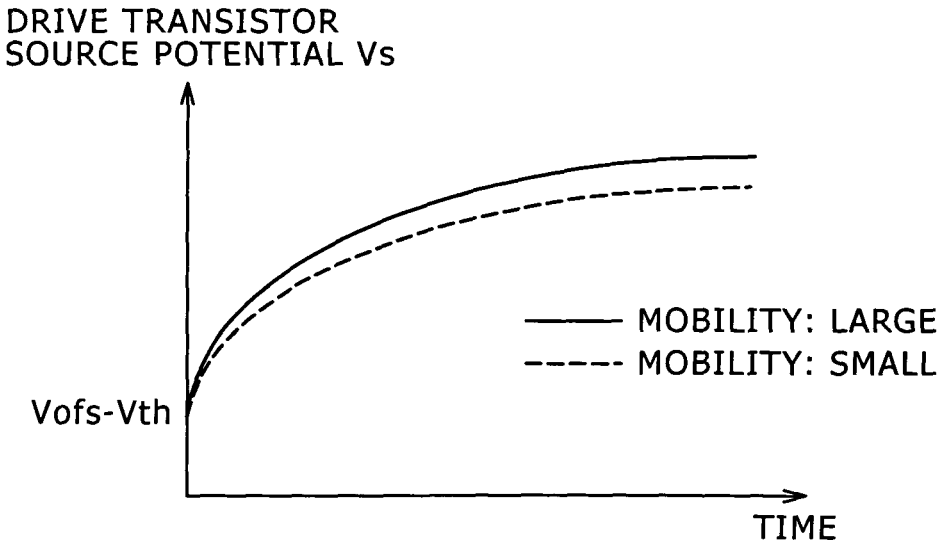
FIG. 14 is a diagram describing in detail the operation of the pixel shown in FIG. 5.
Figure 15:
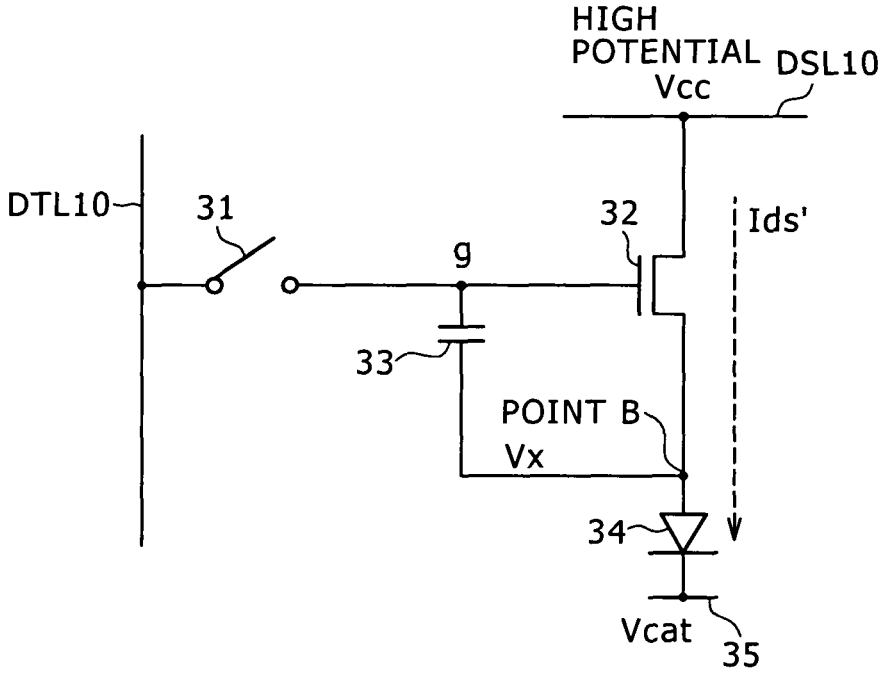
FIG. 15 is a diagram describing in detail the operation of the pixel shown in FIG. 5.

It should be noted that the threshold correction, mobility correction and bootstrapping functions will also be described later in relation to FIGS. 10, 14 and 15.

In the description given below, we assume that even the pixel simply referred to as the pixel 101 has the configuration of the pixel 101*c* shown in FIG. 5.

Figure 6:
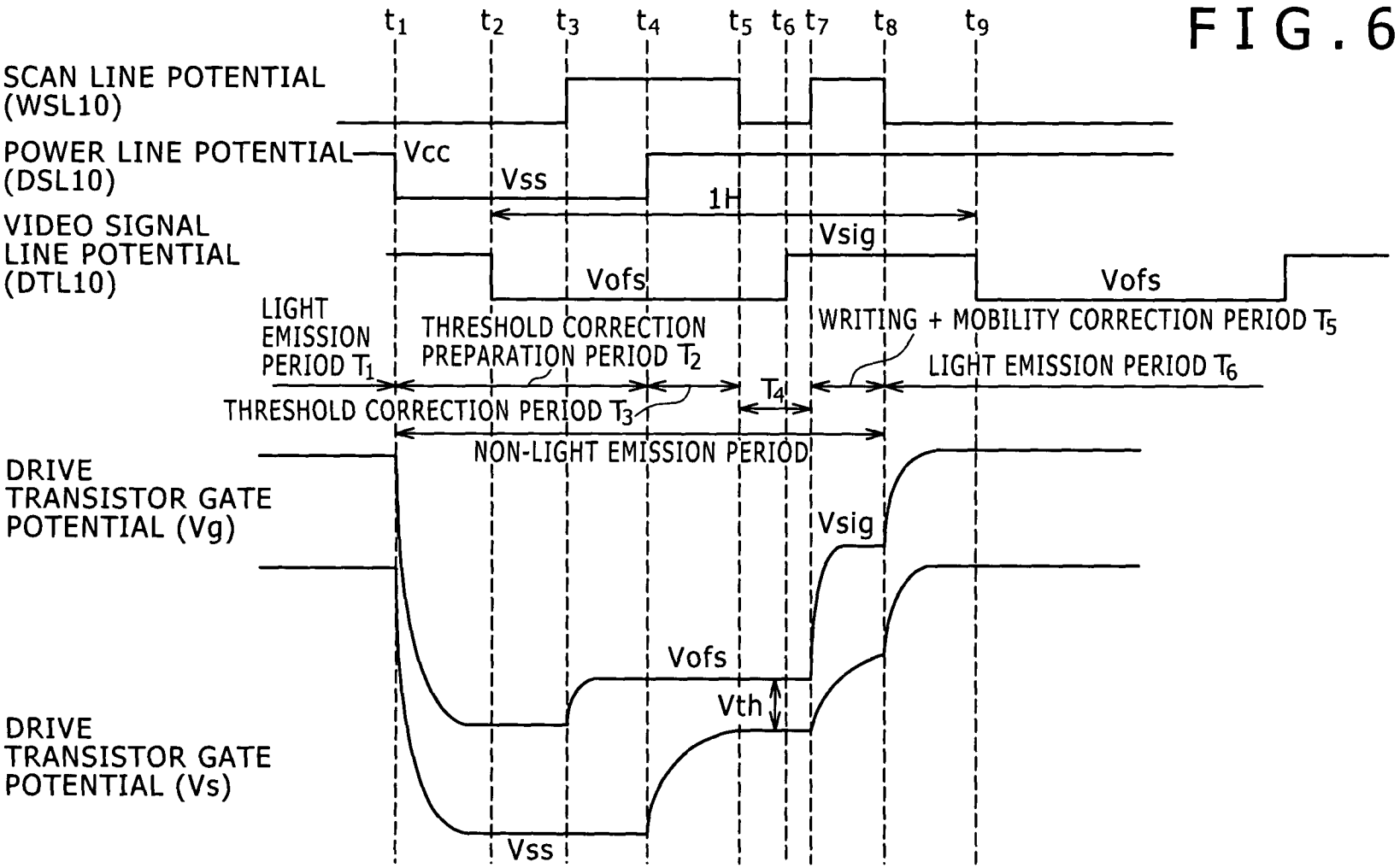
FIG. 6 is a timing diagram describing the operation of the pixel shown in FIG. 5.

FIG. 6 is a timing diagram describing the operation of the pixel 101.

FIG. 6 illustrates, on the same time axis (horizontally in FIG. 6), the changes in potentials of the scan line WSL10, power line DSL10 and video signal line DTL10 and the changes in the gate potential Vg and source potential Vs of the drive transistor 32 associated with the above changes.

In FIG. 6, the period of time up to time $t_1$ is a light emission period $T_1$ during which light emission for the previous horizontal period (1H) takes place.

The period of time from time $t_1$ when the light emission period $T_1$ ends to $t_4$ is a threshold correction preparation period $T_2$. In the same period $T_2$, the gate potential Vg and source potential Vs of the drive transistor 32 are initialized to prepare for the threshold voltage correction.

At time $t_1$ in the same period $T_2$, the power scanner 105 changes the power line DSL10 from the high potential Vcc to the low potential Vss. At time $t_2$, the horizontal selector 103 changes the video signal line DTL10 from the signal potential Vsig to the reference potential Vofs. Next at time $t_3$, the write scanner 104 changes the scan line WSL10 to a high potential, turning on the sampling transistor 31. This resets the gate potential Vg of the drive transistor 32 to the reference potential Vofs, and also resets the source potential Vs of the same transistor 32 to the low potential Vss of the power line DSL10.

The period of time from time $t_4$ to $t_5$ is a threshold correction period $T_3$ adapted to perform threshold correction. At time $t_4$ in the same period $T_3$, the power scanner 105 changes the power line DSL10 to the high potential Vcc. This writes a voltage equivalent to the threshold voltage Vth to the holding capacitor 33 connected between the gate g and source s of the drive transistor 32.

In a writing and mobility correction preparation period $T_4$ from time $t_5$ to $t_7$, the scan line WSL10 is changed temporarily from the high to low potential. At the same time, the horizontal selector 103 changes the video signal line DTL10 from the reference potential Vofs to the signal potential Vsig commensurate with the gray level at time $t_6$ prior to time $t_7$.

Then, in a writing and mobility correction period $T_5$ from time $t_7$ to $t_8$, a video signal is written and mobility correction performed. That is, the scan line WSL10 is pulled up to the high potential from time $t_7$ to $t_8$. This writes the video signal potential Vsig to the holding capacitor 33 in such a manner as to be added to the threshold voltage Vth. This also subtracts a mobility correction voltage $\Delta V\mu$ from the voltage held by the holding capacitor 33.

At time $t_8$ when the writing and mobility correction period $T_5$ ends, the scan line WSL10 is pulled down to the low potential. From this moment onward, the light-emitting element 34 emits light at the brightness commensurate with the signal voltage Vsig. The signal voltage Vsig is adjusted by the voltage equivalent to the threshold voltage Vth and a mobility correction voltage $\Delta V\mu$. This makes the light emission brightness of the light-emitting element 34 immune to the variations in the threshold voltage Vth and mobility $\mu$ of the drive transistor 32.

It should be noted that the bootstrapping takes place at the beginning of a light emission period $T_6$. This raises the gate potential Vg and source potential Vs of the drive transistor 32, with the gate-to-source Vgs of the same transistor 32 maintained constant at $Vsig+Vth-\Delta V\mu$.

Further, at $t_9$ in a predetermined amount of time after time $t_8$, the video signal line DTL10 is pulled from the signal potential Vsig down to the reference potential Vofs. In FIG. 6, the period of time from time $t_2$ to $t_9$ corresponds to the horizontal period (1H).

As described above, in the EL panel 100 with the pixels 101 having the configuration of the pixels 101*c*, the light-emitting element 34 emits light without being affected by the variations in the threshold voltage Vth and mobility $\mu$ of the drive transistor 32.

The operation of the pixel 101 (101*c*) will be described in more detail with reference to FIGS. 7 to 15.

Figure 7:
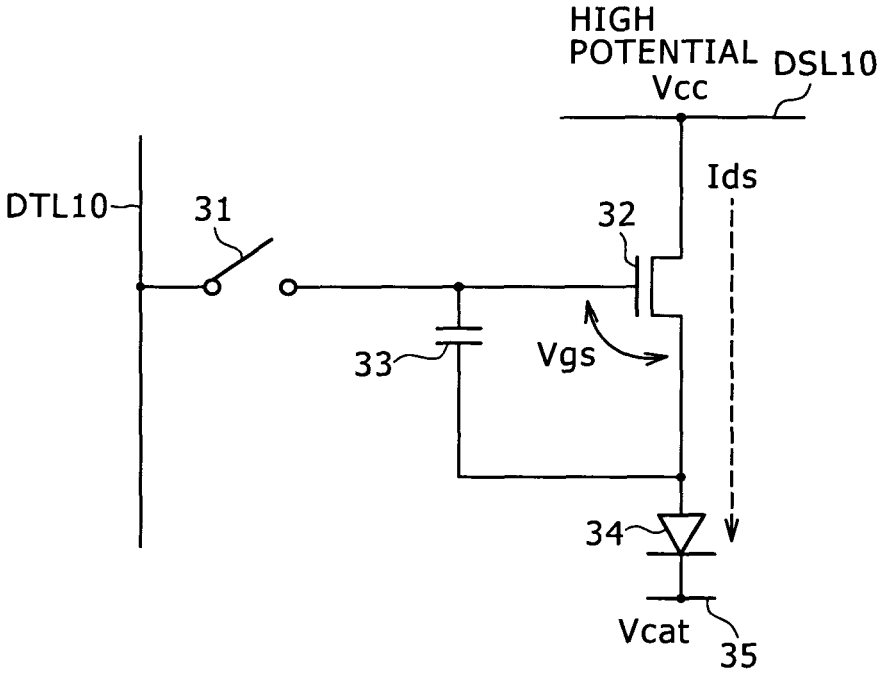
FIG. 7 is a diagram describing in detail the operation of the pixel shown in FIG. 5.

FIG. 7 illustrates the state of the pixel 101 in the light emission period $T_1$.

In the light emission period $T_1$, the sampling transistor 32 is off (scan line WSL10 at the low potential), and the power line DSL10 at the high potential Vcc. As a result, the drive transistor 32 supplies the drive current Ids to the light-emitting element 34. At this time, because the drive transistor 32 is designed to operate in the saturation region, the drive current Ids flowing through the light-emitting element 34 takes on the value commensurate with the gate-to-source voltage Vgs given by Equation (1).

Figure 8:
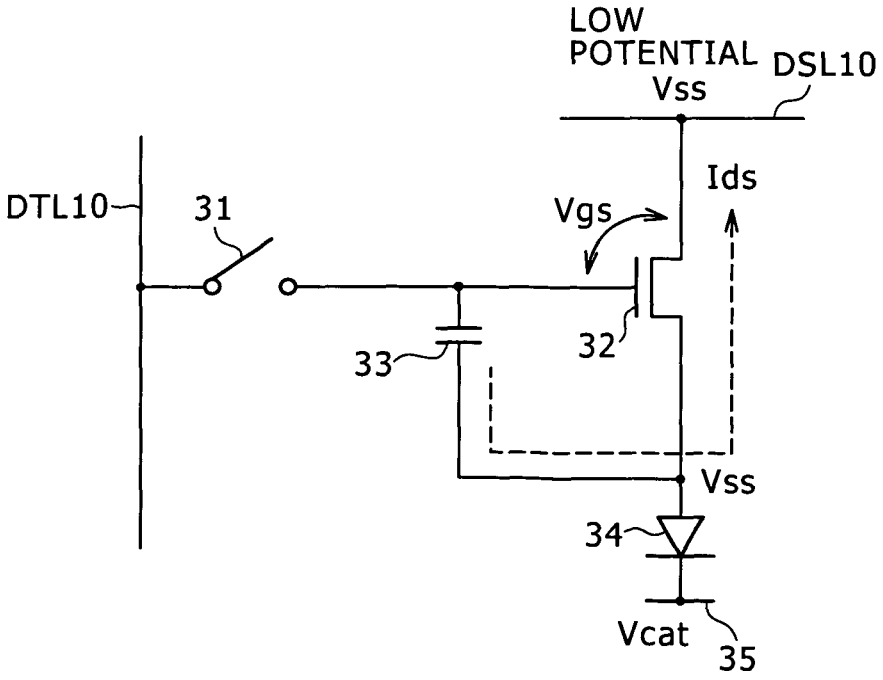
FIG. 8 is a diagram describing in detail the operation of the pixel shown in FIG. 5.

Then, at time $t_1$ at the beginning of the threshold correction preparation period $T_2$, the power scanner 105 changes the power line DSL10 from the high potential (first potential) to the low potential Vss (second potential), as illustrated in FIG. 8. At this time, if the potential Vss of the power line DSL10 is smaller than the sum of a threshold voltage Vthel and cathode potential Vcat of the light-emitting element 34 ($Vss<Vthel+Vcat$), then the same element 34 will stop emitting light. As a result, the terminal of the drive transistor 32 connected to the power line DSL10 now serves as the source s. Further, the anode of the light-emitting element 34 is charged to the potential Vss.

Figure 9:
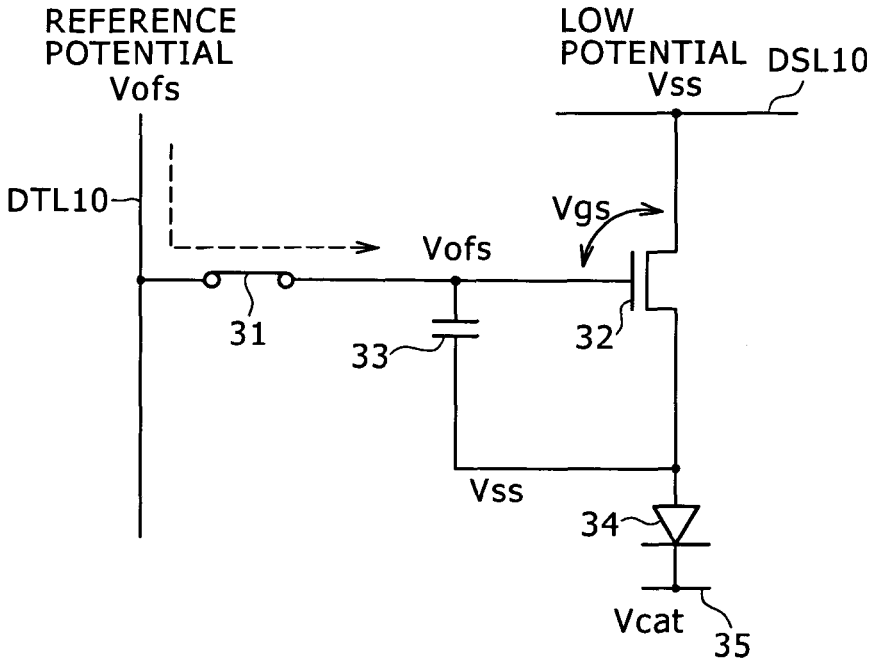
FIG. 9 is a diagram describing in detail the operation of the pixel shown in FIG. 5.

Next, as illustrated in FIG. 9, the horizontal selector 103 changes the video signal line DTL10 to the reference potential Vofs at time $t_2$. Then, at time $t_3$, the write scanner 104 changes the scan line WSL10 to the high potential, turning on the sampling transistor 31. This pulls the gate potential Vg of the drive transistor 32 to Vofs. As a result, the gate-to-source voltage Vgs of the same transistor 32 takes on the value $Vofs-Vss$. Here, the value $Vofs-Vss$ which is the gate-to-source voltage Vgs of the drive transistor 32 must be larger than the threshold voltage Vth ($Vofs-Vss>Vth$) because threshold correction will be performed in the threshold correction period $T_3$ which follows. Conversely, the potentials Vofs and Vss are set so that the condition $Vofs-Vss>Vth$ is satisfied.

Figure 10:
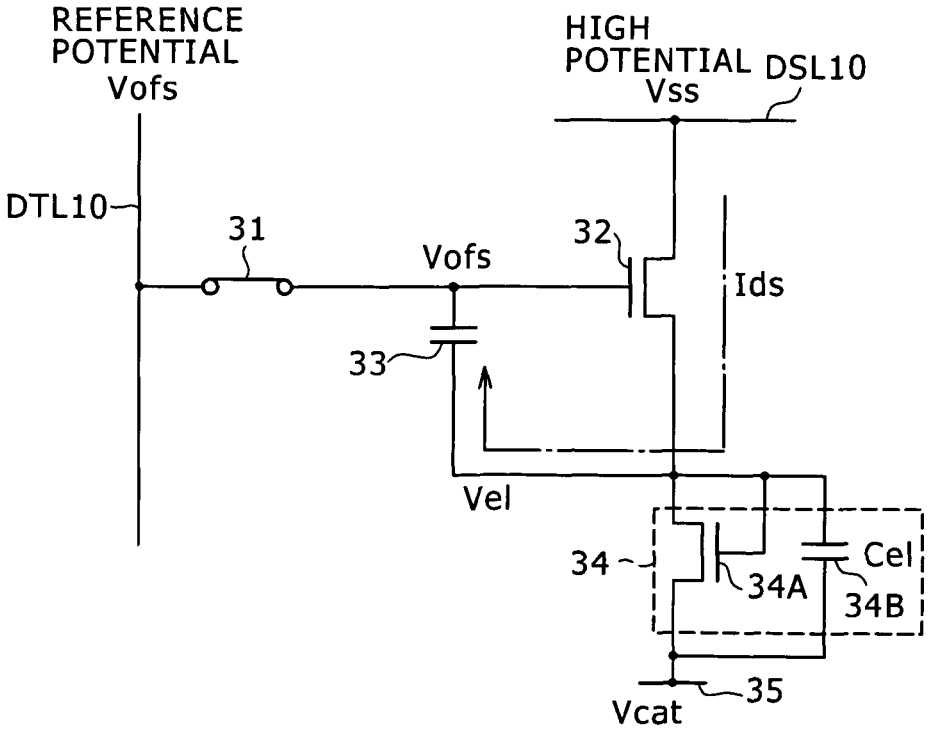
FIG. 10 is a diagram describing in detail the operation of the pixel shown in FIG. 5.

Then, at time $t_4$ at the beginning of the threshold correction period $T_3$, the power scanner 105 changes the power line DSL10 from the low potential Vss to the high potential Vcc as illustrated in FIG. 10. As a result, the terminal of the drive transistor 32 connected to the anode of the light-emitting element 34 now serves as the source s. The current flows as illustrated by a long dashed short dashed line in FIG. 10.

Figure 11:
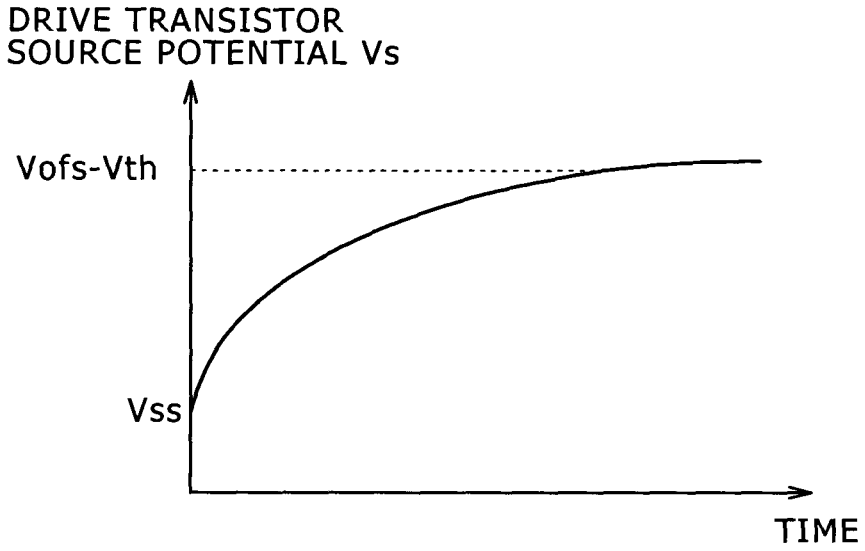
FIG. 11 is a diagram describing in detail the operation of the pixel shown in FIG. 5.

Here, the light-emitting element 34 can be equivalently represented by a holding capacitor 34B made up of a diode 34A and parasitic capacitance Cel. If the leak current of the light-emitting element 34 is significantly smaller than the current flowing through the drive transistor 32 (Vel≦Vcat+Vthel is satisfied), the current flowing through the drive transistor 32 is used to charge the holding capacitors 33 and 34B. An anode potential Vel of the light-emitting element 34 (source potential Vs of the drive transistor 32) increases with increase in the current flowing through the drive transistor 32, as illustrated in FIG. 11. In a predetermined amount of time, the gate-to-source voltage Vgs of the drive transistor 32 takes on the value Vth. On the other hand, the anode potential Vel of the light-emitting element 34 at this time is Vofs−Vth. Here, the anode potential Vel of the light-emitting element 34 is equal to or smaller than the sum of the threshold voltage Vthel and cathode potential Vcat of the same element 34 (Vel=(Vofs−Vth)≦(Vcat+Vthel)).

Figure 12:
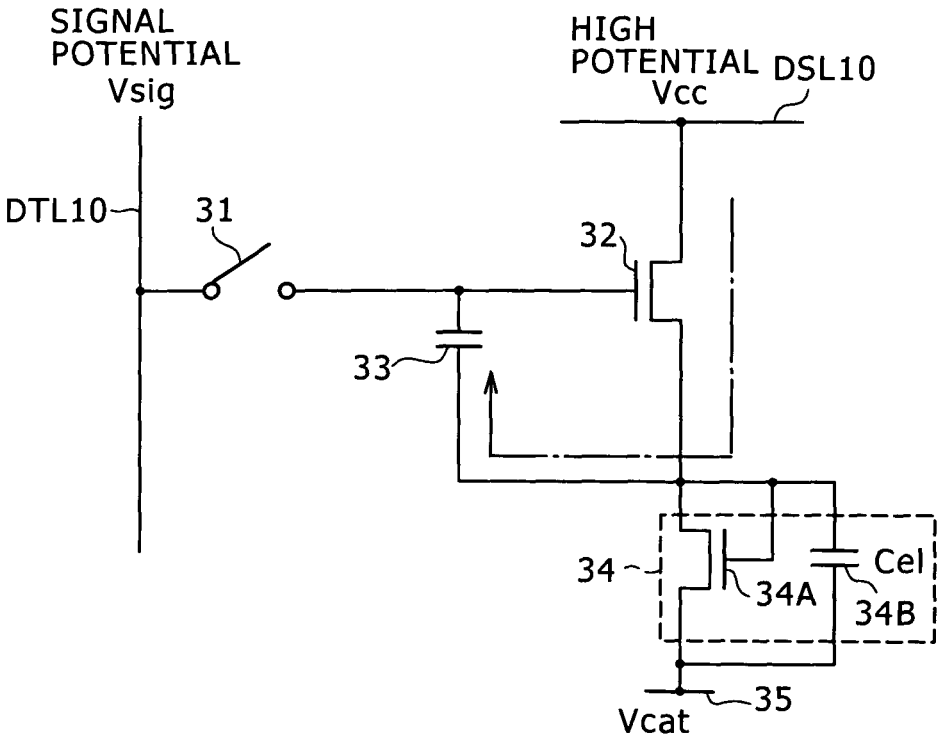
FIG. 12 is a diagram describing in detail the operation of the pixel shown in FIG. 5.

Then, at time $t_5$, the scan line WSL10 is changed from the high to low potential, as illustrated in FIG. 12. This turns off the sampling transistor 31, completing the threshold correction (threshold correction period $T_3$).

At time $t_6$ in the following writing and mobility correction preparation period $T_4$, the horizontal selector 103 changes the video signal line DTL10 from the reference potential Vofs to the signal potential Vsig which is commensurate with the gray level (FIG. 12). Then, the writing and mobility correction period $T_5$ begins, and at time $t_7$, the scan line WSL10 is pulled up to the high potential. This turns on the sampling transistor 31, allowing for the video signal writing and mobility correction to be performed. The gate potential Vg of the drive transistor 32 is equal to Vsig because the sampling transistor 31 is on. However, a current flows from the power line DSL10 into the sampling transistor 31. Therefore, the source potential Vs of the same transistor 32 will rise over time.

The threshold correction operation of the drive transistor 32 is already complete. This eliminates the impact of the threshold correction term on the right side of Equation (1), i.e., $(Vsig-Vofs)^2$. As a result, the current Ids supplied by the drive transistor 32 reflects the mobility μ. More specifically, as illustrated in FIG. 14, if the mobility μ is large, the current Ids supplied by the drive transistor 32 is large, causing the source potential Vs to rise fast. On the other hand, if the mobility μ is small, the current Ids supplied by the drive transistor 32 is small, causing the source potential Vs to rise slowly. In other words, if the mobility μ is large in a predetermined amount of time, an increment $\Delta V_\mu$ (potential correction value) of the source potential Vs of the drive transistor 32 is large. If the mobility μ is small, the increment $\Delta V_\mu$ (potential correction value) of the source potential Vs of the same transistor 32 is small. This reduces the variation in the gate-to-source voltage Vgs of the drive transistor 32 in each of the pixels 101 in response to the mobility μ. In a predetermined amount of time, the gate-to-source voltage Vgs in each of the pixels 101 is set to a level at which the variation in the mobility μ is completely corrected.

At time $t_8$, the scan line WSL10 is pulled down to the low potential, turning off the sampling transistor 31. This terminates the writing and mobility correction period $T_5$ and initiates the light emission period $T_6$ (FIG. 15).

In the light emission period $T_6$, the gate-to-source voltage Vgs of the drive transistor 32 remains constant. Therefore, the same transistor 32 supplies the constant current Ids to the light-emitting element 34. As a result, the anode potential Vel of the light-emitting element 34 rises to a voltage Vx at which a constant current Ids' flows through the light-emitting element 34, causing the same element 34 to emit light. As the source potential Vs of the drive transistor 32 increase, the gate potential Vg of the same transistor 32 will also increase because of the bootstrapping function of the holding capacitor 33.

In the pixel 101 using the pixel 101*c*, the I-V characteristic of the light-emitting element 34 also changes after a long light emission time. This also changes the potential at a point B shown in FIG. 15 over time. However, the gate-to-source voltage Vgs of the drive transistor 32 is maintained constant. As a result, the current flowing through the light-emitting element 34 remains unchanged. Even in the event of a secular change of the I-V characteristic of the light-emitting element 34, therefore, the constant current Ids' continues to flow. As a result, the brightness of the same element 34 remains unchanged.

As described above, the EL panel 100 shown in FIG. 5 incorporating the pixels 101 (101*c*) can correct the differences in the threshold voltage Vth and mobility u between the different pixels 101 using the threshold and mobility correction functions. The same panel 100 can also correct the secular change (deterioration) of the light-emitting element 34.

This makes it possible for the display device using the EL panel 100 shown in FIG. 5 to provide a high-quality image.

However, it can be said, from the comparison in configuration between the EL panel 100 and a liquid crystal display (LCD), that the EL panel 100 has more control lines because the LCD has no control lines equivalent to the power lines DSL10.

Figure 16:
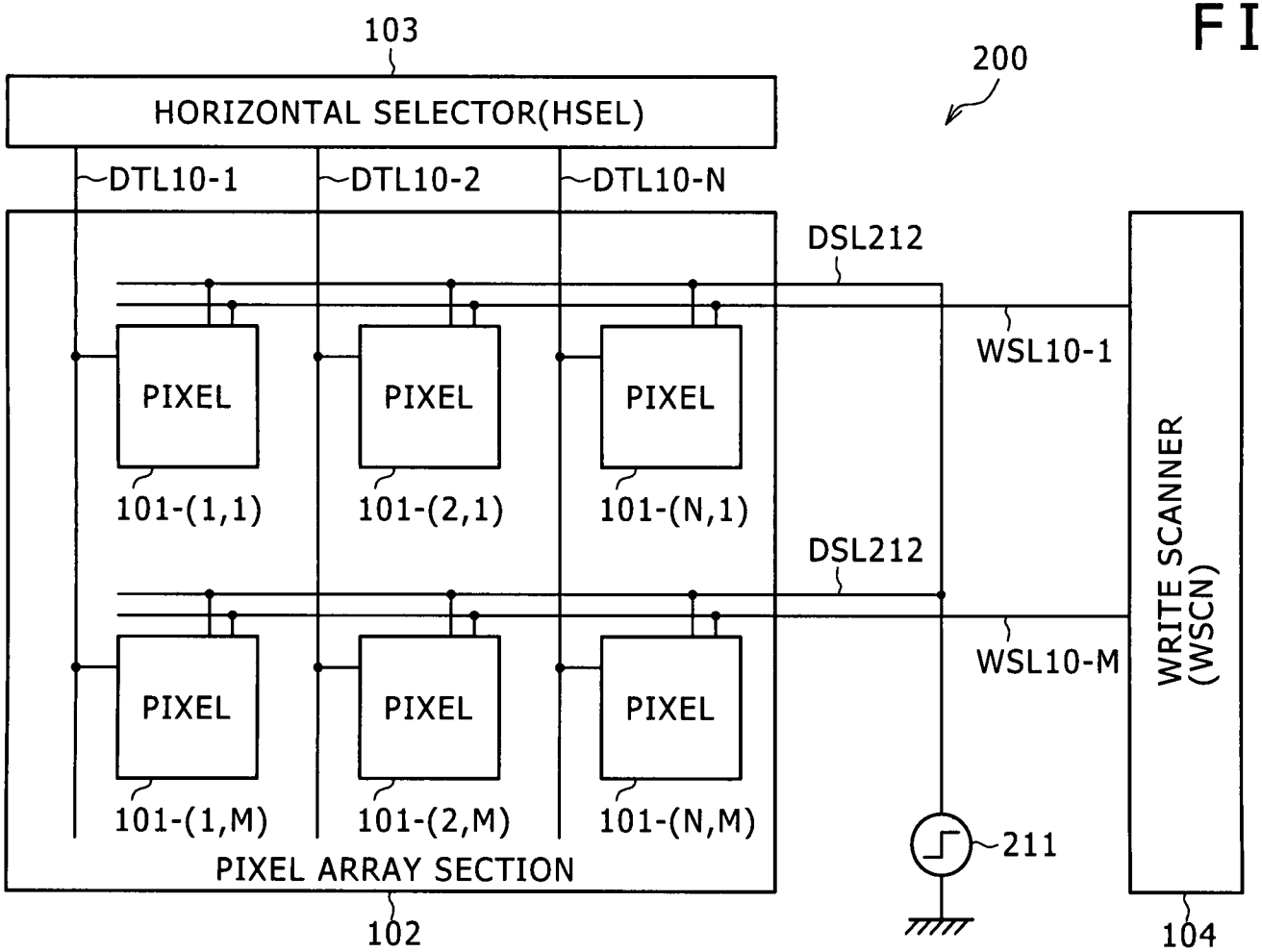
FIG. 16 is a block diagram illustrating a configuration example of an embodiment of the EL panel to which an embodiment of the present invention is applied.

For this reason, an EL panel 200 is illustrated in FIG. 16 as a lower cost EL panel having a simpler configuration.

That is, FIG. 16 is a block diagram illustrating a configuration example of an embodiment of the EL panel to which the present invention is applied. In FIG. 16, like components as those in FIG. 1 are denoted by like reference numerals, and the description thereof will be omitted as appropriate.

The EL panel 100 shown in FIG. 1 has the power lines DSL10-1 to 10-M, one line each for each row of the pixels 101. In contrast, the EL panel 200 has a common power line DSL212 for all the pixels 101. The source voltage at the high potential Vcc serving as the first potential or low potential Vss serving as the second potential is supplied to all the pixels 101 in an across-the-board manner. That is, the power supply section 211 controls the source voltage for all the pixels 101 of the pixel array section 102 in the same manner.

The EL panel 200 is configured in the same manner as the EL panel 100 in FIG. 1 except for the power supply section 211 and power line DSL212. It should be noted, however, that each of the pixels 101 of the pixel array section 102 has the configuration of the pixel 101*c*.

Figure 17:
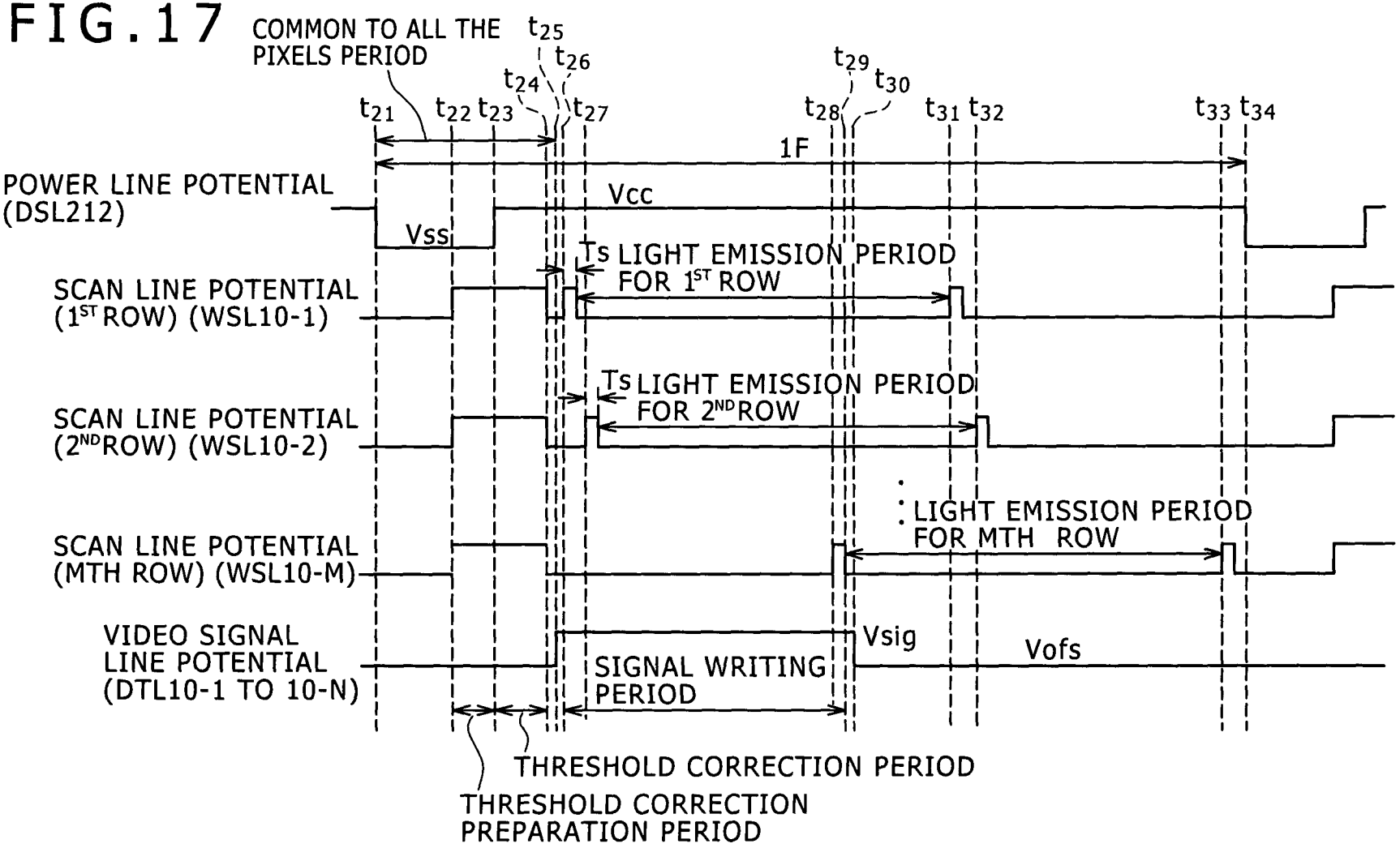
FIG. 17 is a timing diagram describing a basic drive control method of the EL panel shown in FIG. 16.

A description will be given next of a basic drive control method of the EL panel 200 (hereinafter referred to as the basic drive control method) with reference to FIG. 17. FIG. 17 illustrates the timing at which all the pixels 101 are supplied with the source voltage from the power supply section 211 via the power line DSL212. FIG. 17 also illustrates the timings at which the pixels 101 in the different rows begin to emit light.

In FIG. 17, the period of time from time $t_{21}$ to $t_{34}$ is the unit time for displaying a single image (hereinafter referred to as one field period (1F)). Of the above period, the period from time $t_{21}$ to $t_{25}$ is the period during which all the pixels are commonly controlled (hereinafter referred to as the period common to all the pixels). Further, the period from time $t_{25}$ to $t_{34}$ is the line sequential scan period during which all the pixels are scanned in a line sequential manner.

First, at time $t_{21}$ in the period common to all the pixels, the power supply section 211 changes the power line DSL211 from the high potential Vcc to the low potential Vss. It should be noted that, at time $t_{21}$, the scan lines WSL10-1 to 10-M and video signal lines DTL10-1 to 10-N are set respectively to their low potentials.

Then, at time $t_{22}$, the write scanner 104 simultaneously changes the scan lines WSL10-1 to 10-M to the high potential. This sets the gate potential Vg of the drive transistor 32 equal to Vofs, and the source potential Vs of the same transistor 32 equal to Vss, as described with reference to FIG. 9. Therefore, the gate-to-source voltage Vgs takes on the value Vofs−Vss (>Vth) which is greater than the threshold voltage Vth of the drive transistor 32. As a result, the threshold correction preparation prior to the threshold correction is performed. Therefore, the period of time from time $t_{22}$ to $t_{23}$ is the threshold correction preparation period.

At time $t_{23}$ after the preparation is complete for the threshold correction, the power supply section 211 changes the power line DSL211 from the low potential Vss to the high potential Vcc, initiating the threshold correction for all the pixels 101 at the same time. That is, as described with reference to FIG. 10, the anode potential Vel of the light-emitting element 34 (source potential of the drive transistor 32) increases with increase in the current flowing through the drive transistor 32. In a predetermined amount of time, the anode potential Vel will be equal to Vofs−Vth. At time $t_{24}$, the write scanner 104 changes the scan lines WSL10-1 to 10-M to the low potential in unison, terminating the threshold correction.

Then, the line sequential scan period begins from time $t_{25}$. This period is designed to write a video signal to the pixels 101 in a line sequential manner.

That is, in the period from time $t_{25}$ to $t_{30}$, each of the potentials of the video signal lines DTL10-1 to 10-N is set to the signal potential Vsig commensurate with the gray level. During this period, the write scanner 104 changes the scan lines WSL10-1 to 10-M to the high potential successively (in a line sequential manner) only for a period of time Ts. The light-emitting elements 34 of the pixels 101 in the row, which has been changed to the high potential for a period of the time Ts, emit light.

Figure 13:
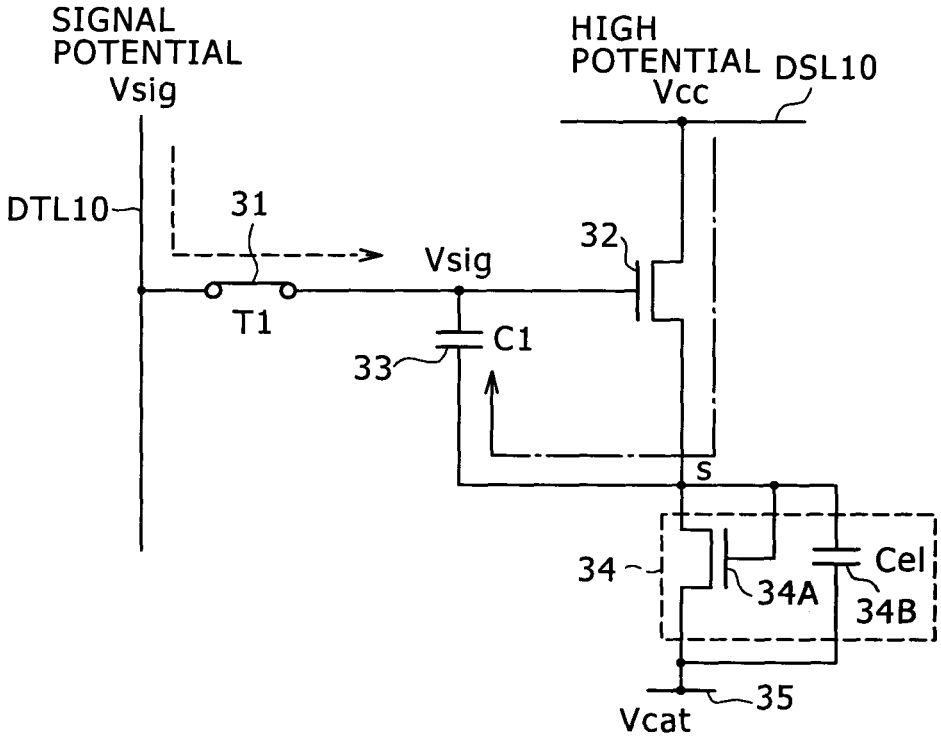
FIG. 13 is a diagram describing in detail the operation of the pixel shown in FIG. 5.

It should be noted that, during a period of time in which the scan lines WSL10 are set to the high potential, the source potential Vs of the drive transistor 32 will increase as described with reference to FIG. 13. As a result, the mobility correction is performed together with the video signal writing.

When the supply of the high potential to the scan line WSL10-M in the Mth row ends, each of the video signal lines DTL10-1 to 10-N is changed to the reference potential Vofs at time $t_{30}$.

Then, with the reference potential Vofs supplied to the video signal lines DTL10-1 to 10-N, the write scanner 104 changes, from time $t_{31}$, the scan lines WSL10-1 to 10-M to the high potential successively (in a line sequential manner) only for a period of the time Ts. In the pixels 101 in the row which has been changed to the high potential for a period of the time Ts, the reference potential Vofs is supplied to the gate g of the drive transistor 32. This brings the gate-to-source voltage Vgs of the drive transistor 32 down to the threshold voltage Vth or less, causing the light-emitting element 34 to stop emitting light. Here, in order for the same element 34 to stop emitting light, the potential supplied to the gate g of the drive transistor 32 need not necessarily be the reference potential Vofs, but rather it need only be equal to or less than the sum of the cathode potential Vcat and threshold voltage Vthel of the light-emitting element 34 and the threshold voltage Vth of the drive transistor 32 (Vcat+Vthel+Vth). However, control can be simplified if the potential supplied to the gate g is equal to the threshold correction reference potential Vofs.

The basic control method turns on the sampling transistor 31, with the reference potential Vofs supplied to the video signal lines DTL10, to cause the light-emitting element 34 to stop emitting light, thus controlling the light emission period of each row. Therefore, the light emission period spans from when the sampling transistor 31 turns off with the signal potential Vsig supplied to the video signal lines DTL10 to when the sampling transistor 31 turns on with the reference potential Vofs supplied to the video signal lines DTL10. It should be noted that the light emission period must be the same between the different rows. Therefore, the writing of the video signal to the last Mth row must take place a light emission period prior to the end of the one field period.

As described above, the EL panel 200 circuitry can be made simpler and power control easier by providing the power line DSL212 shared by all the pixels and performing the threshold correction preparation and threshold correction simultaneously (in unison) on all the pixels during the period common to all the pixels. This provides reduced cost of the panel as a whole.

Incidentally, in the basic drive control method described with reference to FIG. 17, the period of time from the end of the threshold correction period to when the pixels 101 in each row begin to emit light differs from one row to another. During the period of time from the end of the threshold correction period to when the pixels 101 in each row begin to emit light, three different leak currents exist to be exact, namely, the leak currents of the drive transistor 32, light-emitting element 34 and sampling transistor 31. As a result, the gate potential Vg and source potential Vs of the drive transistor 32 change due to these leak currents after the end of the threshold correction period. More specifically, the source potential Vs of the drive transistor 32 changes (increases) toward the potential Vcc of the power line DSL212 because of the leak current of the same transistor 32 and changes (increases) toward the cathode potential Vcat because of the leak current of the light-emitting element 34. The gate potential Vg of the same transistor 32 also changes (increases) with the change of the source potential Vs.

Here, we let the increment of the gate potential Vg and source potential Vs of the drive transistor 32 be ΔV. We also let the potential change caused by the leak current of the sampling transistor 31 be ΔV2. Then, the change of the source potential Vs of the drive transistor 32 for the potential change ΔV can be expressed as gΔV2. The factor g is determined by the capacitance of the holding capacitor 33, the gate-to-source capacitance of the drive transistor 32 and the parasitic capacitance of the light-emitting element 34.

Assuming now that the potential changes ΔV and ΔV2 are both positive, the gate potential Vg of the drive transistor 32 immediately before the video signal writing can be expressed as Vofs+ΔV+ΔV2. The source potential Vs can be expressed as Vofs−Vth+ΔV+gΔV2. These potential changes ΔV and ΔV2 differ between the different pixels 101 because they are significantly affected by the variations in leak currents of the pixels 101. As a result, these changes are a contributor to poor image quality such as unevenness and shading of the EL panel 200.

Therefore, the EL panel 200 may use the drive control method (hereinafter referred to as the first drive control method) shown in FIG. 18 to prevent the potential changes caused by the leak currents.

Figure 18:
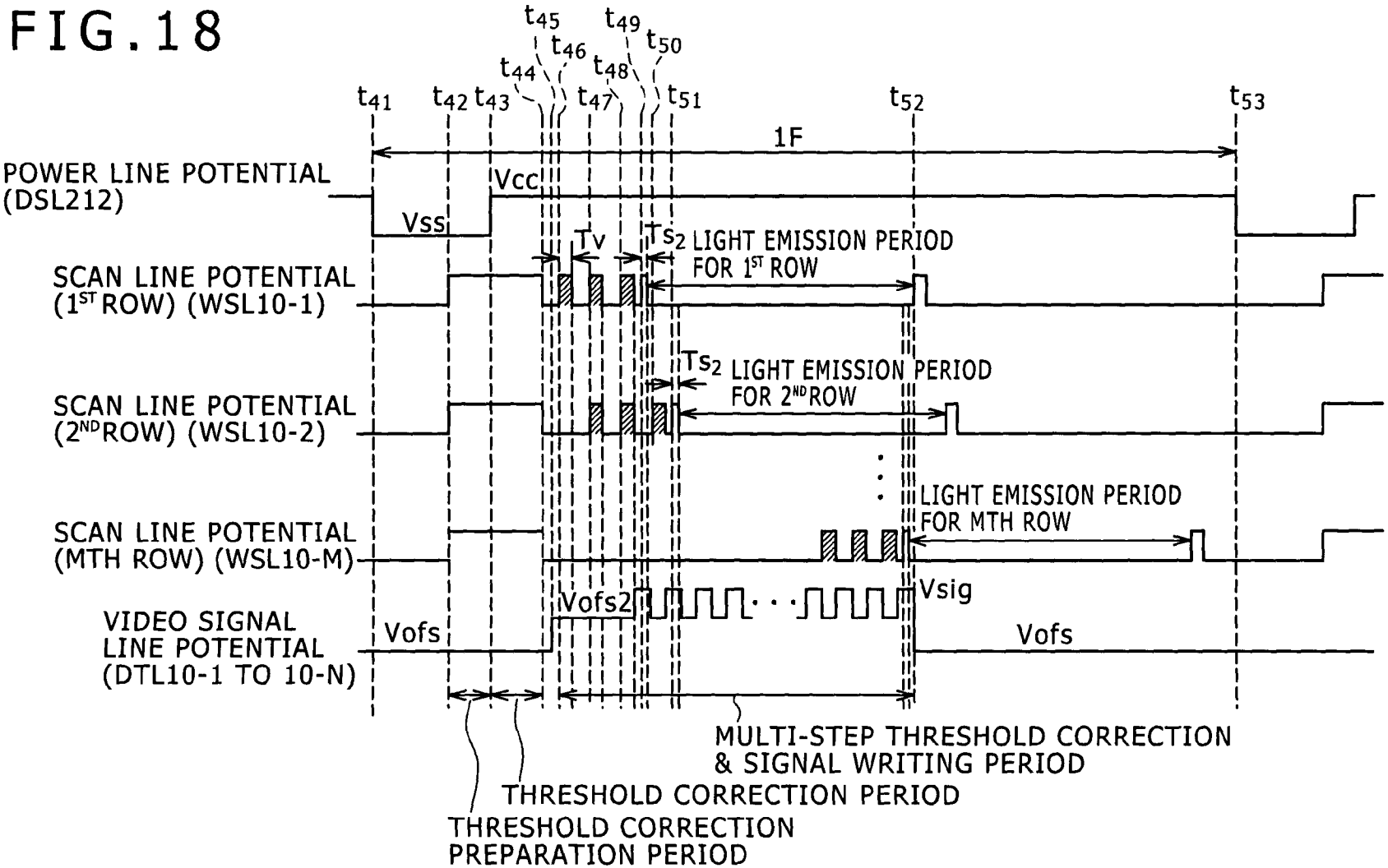
FIG. 18 is a timing diagram describing a first drive control method of the EL panel shown in FIG. 16.

The operation from time $t_{41}$ to $t_{44}$ during the one field period (1F) from time $t_{41}$ to $t_{53}$ in FIG. 18 is the same as the operation from time $t_{21}$ to $t_{24}$ in FIG. 17. That is, the threshold correction preparation and threshold correction are performed simultaneously on all the pixels of the EL panel 200 in the period of time from time $t_{41}$ to $t_{44}$.

Then, from time $t_{44}$ onward, the video signal lines DTL10-1 to 10-N are pulled up to the second reference potential Vofs2 higher than the reference potential Vofs, followed by multi-step threshold correction and writing of the signal voltage at the signal potential Vsig performed in a line sequential manner.

More specifically, at time $t_{45}$ later than time $t_{44}$, the video signal lines DTL10-1 to 10-N are changed in unison to the second reference potential Vofs2, followed by the multi-step threshold correction and writing of the video signal to the pixels 101 in the first row.

That is, with the video signal lines DTL10-1 to 10-N set to the second reference potential Vofs2, the scan line WSL10-1 is changed to the high potential three times for a period of Tv time each, namely, for a period of the Tv time from time $t_{46}$, from time $t_{47}$ and from time $t_{48}$. Next, the video signal lines DTL10-1 to 10-N are set to the signal potential Vsig commensurate with the gray level. During this period, the scan line WSL10-1 is changed to the high potential for a period of $Ts_2$ time, causing the video signal at the signal potential Vsig to be written to the pixels 101 in the first row. The pixels 101 begin to emit light after the writing of the video signal at the signal potential Vsig.

The three-step threshold correction and video signal writing are also performed on the pixels in the second to Mth rows successively at the same timings. It should be noted that the timings at which the sampling transistor 31 is on for the three-step threshold correction are shaded in FIG. 18.

At time $t_{52}$ after the end of the video signal writing to the pixels in the Mth row, the video signal lines DTL10-1 to 10-N are changed to the reference potential Vofs. From this moment onward, the sampling transistor 31 turns on in the same manner as in the case shown in FIG. 17 so that the light emission period is the same between the different rows. This causes the light-emitting element 34 to stop emitting light.

In order for the light-emitting element 34 to stop emitting light, the potential supplied to the gate g of the drive transistor 32 need not necessarily be the reference potential Vofs, but rather it need only be equal to or less than the sum of the cathode potential Vcat and threshold voltage Vthel of the light-emitting element 34 and the threshold voltage Vth of the drive transistor 32 (Vcat+Vthel+Vth). Alternatively, the potential supplied to the gate g of the drive transistor 32 may be a reverse bias potential reflecting the light emission brightness.

A detailed description will be given of the changes in the gate potential Vg and source potential Vs of the drive transistor 32 of the pixel 101-(N,M) with reference to FIG. 19 with focus on the pixel 101-(N,M) in the Mth row and Nth column.

The period of time from time $t_{42}$ to $t_{43}$ is the threshold correction preparation period during which the threshold correction preparation is performed in unison on all the pixels. The period of time from time $t_{43}$ to $t_{44}$ is the threshold correction period during which the threshold correction is performed in unison on all the pixels.

In the threshold correction preparation period, the sampling transistor 31 turns on, causing the gate potential Vg of the drive transistor 32 to increase to the reference potential Vofs which is the potential of the video signal line DTL10-N. In the threshold correction period, the power line DSL changes to the high potential, causing the source potential Vs of the drive transistor 32 to increase to such an extent that the gate-to-source voltage Vgs of the same transistor 32 becomes equal to the threshold voltage Vth.

During the period of time from time $t_{45}$ when the video signal line DTL10-N is changed to the second reference potential Vofs2 to time $t_{61}$ when the multi-step threshold correction is performed on the pixel 101-(N,M) of interest, the gate potential Vg and source potential Vs of the drive transistor 32 will increase due to the leak currents of the drive transistor 32, light-emitting element 34 and sampling transistor 31. The increment of the gate potential Vg of the drive transistor 32 is ΔV+ΔV2 as described earlier. It should be noted that the source potential Vs of the same transistor 32 is equal to or smaller than the cathode potential Vcat.

The write scanner 104 turns on the sampling transistor 31 for a period of the Tv time from time $t_{61}$. The second reference potential Vofs2 is set larger than the gate potential Vg of the drive transistor 32 after the increase (Vofs+ΔV+ΔV2). This makes the gate-to-source voltage Vgs of the same transistor 32 larger than the threshold voltage Vth, thus initiating the threshold correction. In other words, the second reference potential Vofs2 must be larger than the gate potential Vg of the drive transistor 32 after the increase (Vofs+ΔV+ΔV2) in order for the threshold correction to begin. Further, as described with reference to FIG. 10, the condition Vel≦(Vcat+Vthel) must be satisfied in order for the current flowing through the drive transistor 32 to charge the holding capacitor 33.

After the end of the first multi-step threshold correction period which lasts for a period of the Tv time from time $T_{61}$, the sampling transistor 31 is turned off for a predetermined amount of time up to time $t_{63}$.

During a period of time from time $t_{63}$ to $t_{67}$, the sampling transistor 31 is turned on and off twice in the same manner, performing the multi-step threshold correction twice. At time $t_{66}$ when the third multi-step threshold correction ends, the gate potential Vg of the drive transistor 32, the source potential Vs thereof and the gate-to-source voltage Vgs are Vofs2, Vofs−Vth and Vth respectively.

Then, the write scanner 104 turns on the sampling transistor 31 again for a period of the $Ts_2$ time from time $t_{67}$ in a predetermined amount of time after the video signal line DTL10-N is changed to the signal potential Vsig commensurate with the gray level. This performs the video signal writing and mobility correction. At time $t_{68}$, the sampling transistor 31 is turned off, causing the pixel 101-(N,M) to begin to emit light.

As described above, the threshold correction is performed immediately prior to the video signal writing, ensuring shorter time from the threshold correction to the video signal writing. This suppresses the leak currents of the drive transistor 32, light-emitting element 34 and sampling transistor 31, providing a uniform image free from uneven quality attributable to the variations in leak currents between the different pixels 101.

Further, the time from the threshold correction to the video signal writing can be made constant between the different rows, thus providing a uniform image free from image quality degradation such as shading.

Figure 19:
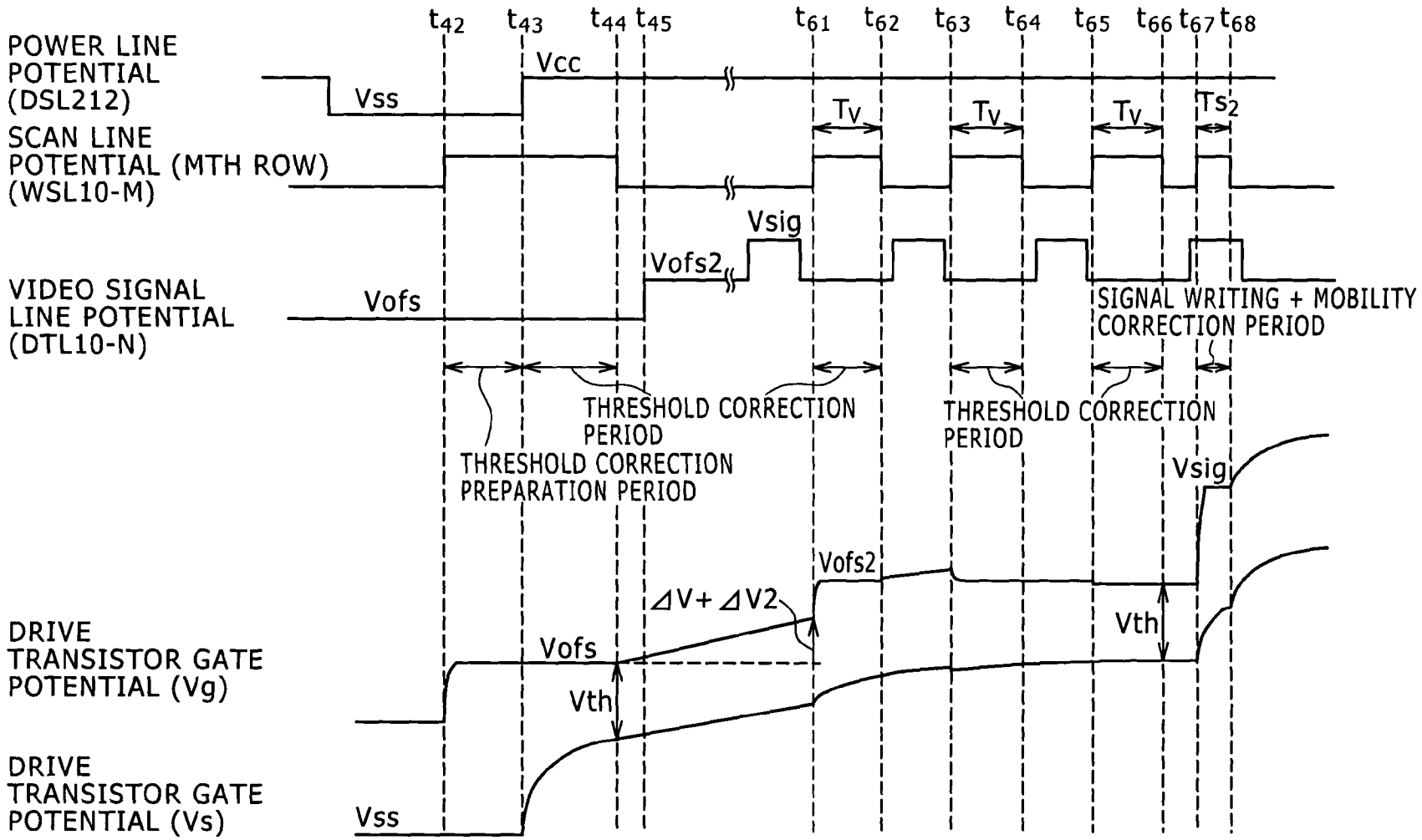
FIG. 19 is a diagram describing the changes in gate and source potentials of a drive transistor according to the first drive control method.

That is, the first drive control method described with reference to FIGS. 18 and 19 provides improved image quality.

A description will be given next of a second drive control method used by the EL panel 200 with reference to FIG. 20.

Figure 20:
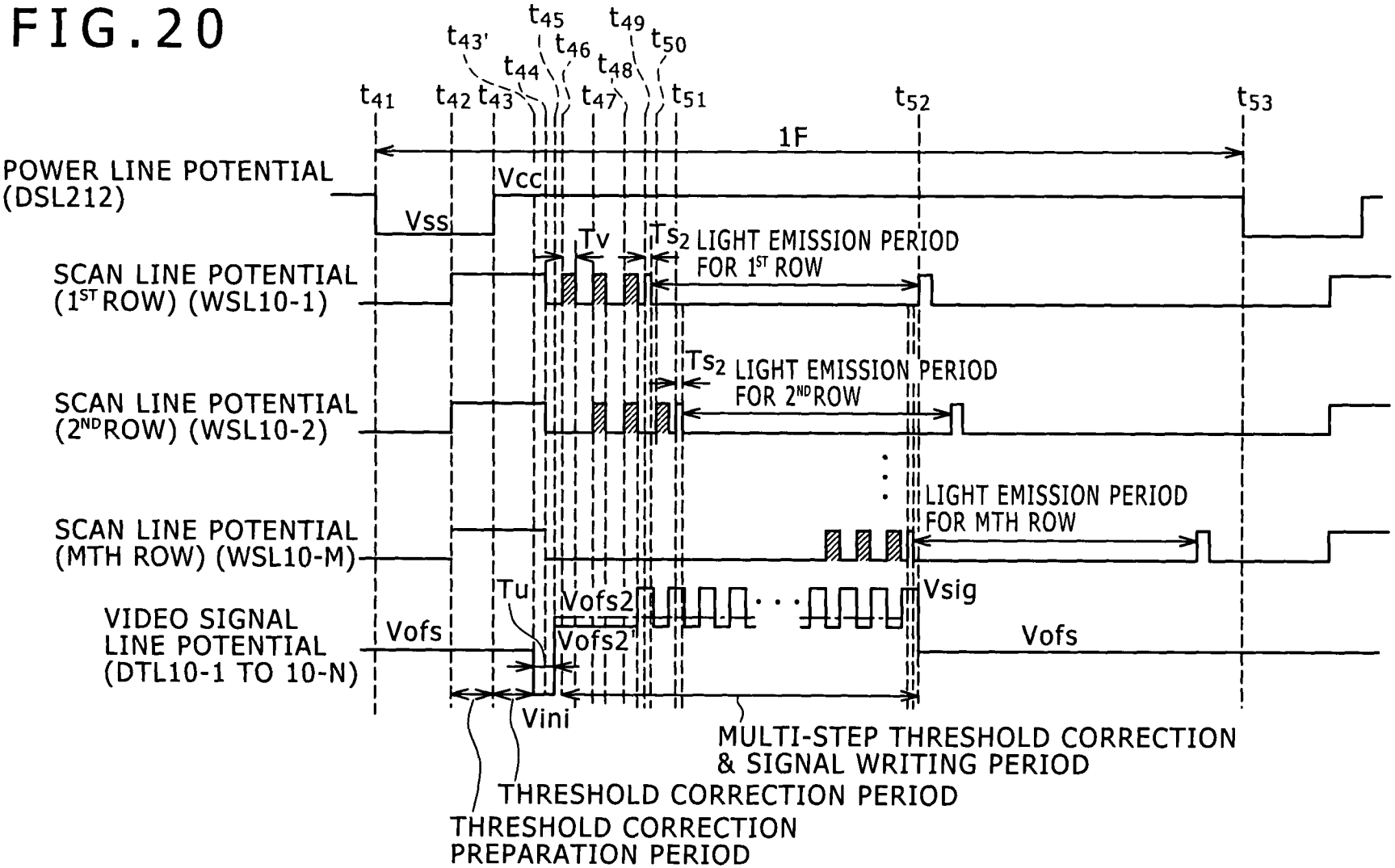
FIG. 20 is a timing diagram describing a second drive control method of the EL panel shown in FIG. 16.

In FIG. 20, like components as those in FIG. 18 are denoted by like reference numerals, and the description thereof will be omitted as appropriate.

In FIG. 20, the video signal lines DTL10 are pulled from the reference potential Vofs down to a third reference potential Vini for a period of Tu time from time $t_{43}$, to $t_{44}$ following time $t_{43}$.

In terms of the reduction of the leak currents of the drive transistor 32, light-emitting element 34 and sampling transistor 31 to the extent possible, the current (leak current) flowing through the drive transistor 32 can be reduced by reducing the gate-to-source voltage Vgs of the same transistor 32 because of the relationship CV=it where C is the capacitance, V the voltage, i the current and t the time. In the second drive control method, therefore, the third reference potential Vini is supplied to the gate potential Vg of the drive transistor 32 before the second reference potential Vofs2 is supplied to the same potential Vg.

This allows for reduction of the gate-to-source voltage Vgs of the drive transistor 32, thus providing a smaller leak current. Therefore, the increment (ΔV+ΔV2) of the gate potential Vg of the drive transistor 32 is smaller than in the first drive control method described with reference to FIG. 19. As a result, the second reference potential which must be set larger than the gate potential Vg of the drive transistor 32 after the increase (Vofs+ΔV+ΔV2) need only be set to Vofs2' which is smaller than Vofs2 in the first drive control method. In other words, the second reference potential Vofs2' can be reduced below the second reference potential Vofs2 as illustrated in FIG. 20 by supplying the third reference potential Vini which is lower than the reference potential Vofs.

Figure 21:
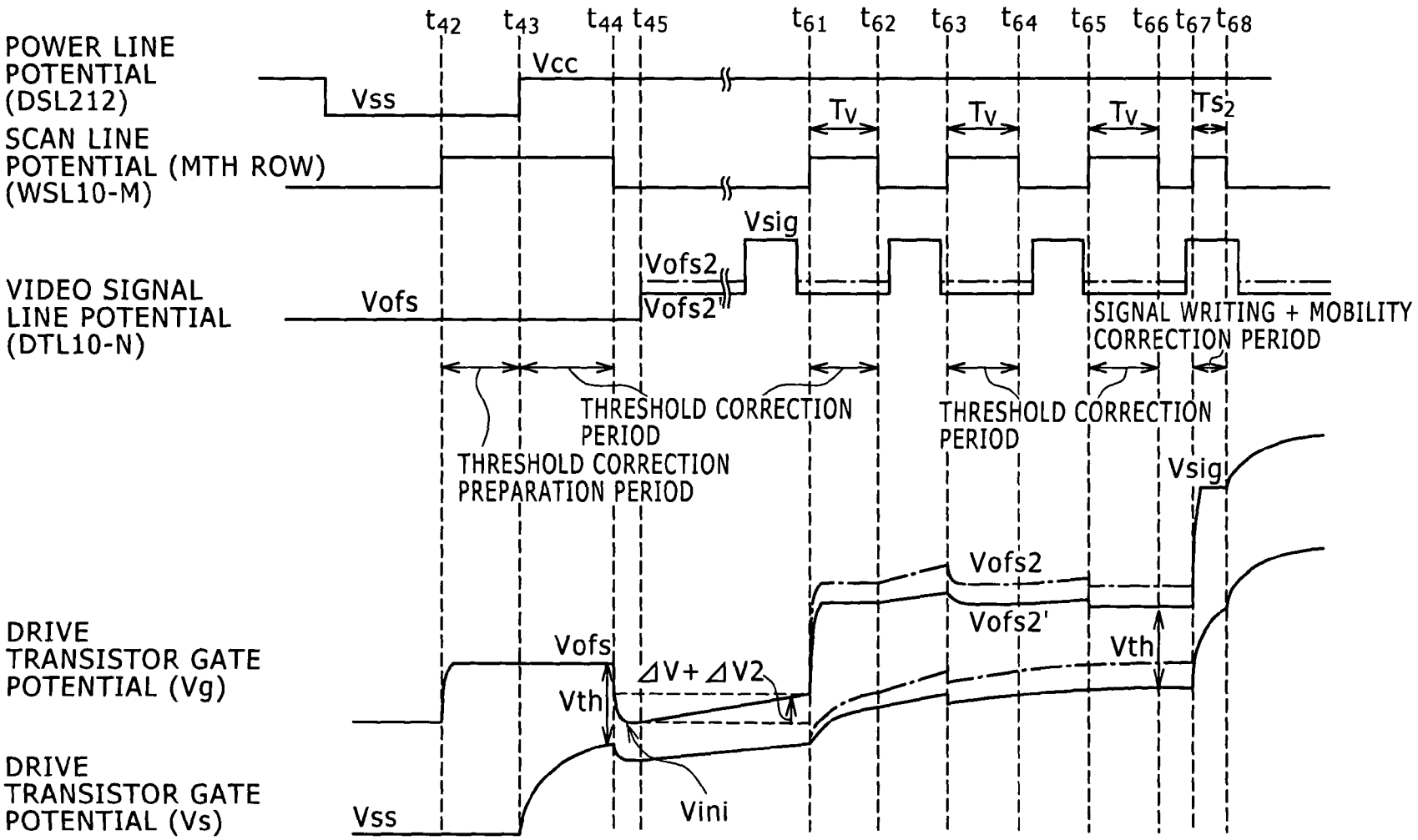
FIG. 21 is a diagram describing the changes in the gate and source potentials of the drive transistor according to the second drive control method.

FIG. 21, associated with FIG. 19 for the first drive control method, is a diagram illustrating the changes in the gate and source potentials Vg and Vs of the drive transistor 32 in the pixel 101-(N,M) according to the second drive control method.

As is clear with reference to FIG. 21, the increment (ΔV+ΔV2) of the gate potential Vg of the drive transistor 32 up to time $t_{61}$ when the multi-step threshold correction is performed one row at a time is smaller in the second drive control method shown in FIG. 21 than in the first one shown in FIG. 19. Further, the second reference potential supplied to the video signal lines DTL10 at time $t_{45}$ is Vofs2' which is lower than Vofs2, as described above (second reference potential Vofs2 is shown by a long dashed short dashed line for purpose of comparison).

As with the first drive control method, the second one ensures shorter time from the threshold correction to the video signal writing by performing the threshold correction immediately before the video signal writing. This suppresses the leak currents of the drive transistor 32, light-emitting element 34 and sampling transistor 31, providing a uniform image free from uneven quality attributable to the variations in leak currents between the different pixels 101.

Further, the time from the threshold correction to the video signal writing can be made constant between the different rows, thus providing a uniform image free from image quality degradation such as shading.

Still further, the second drive control method provides the second reference potential Vofs2' lower than the second reference potential Vofs2 in the first one.

Figure 22:
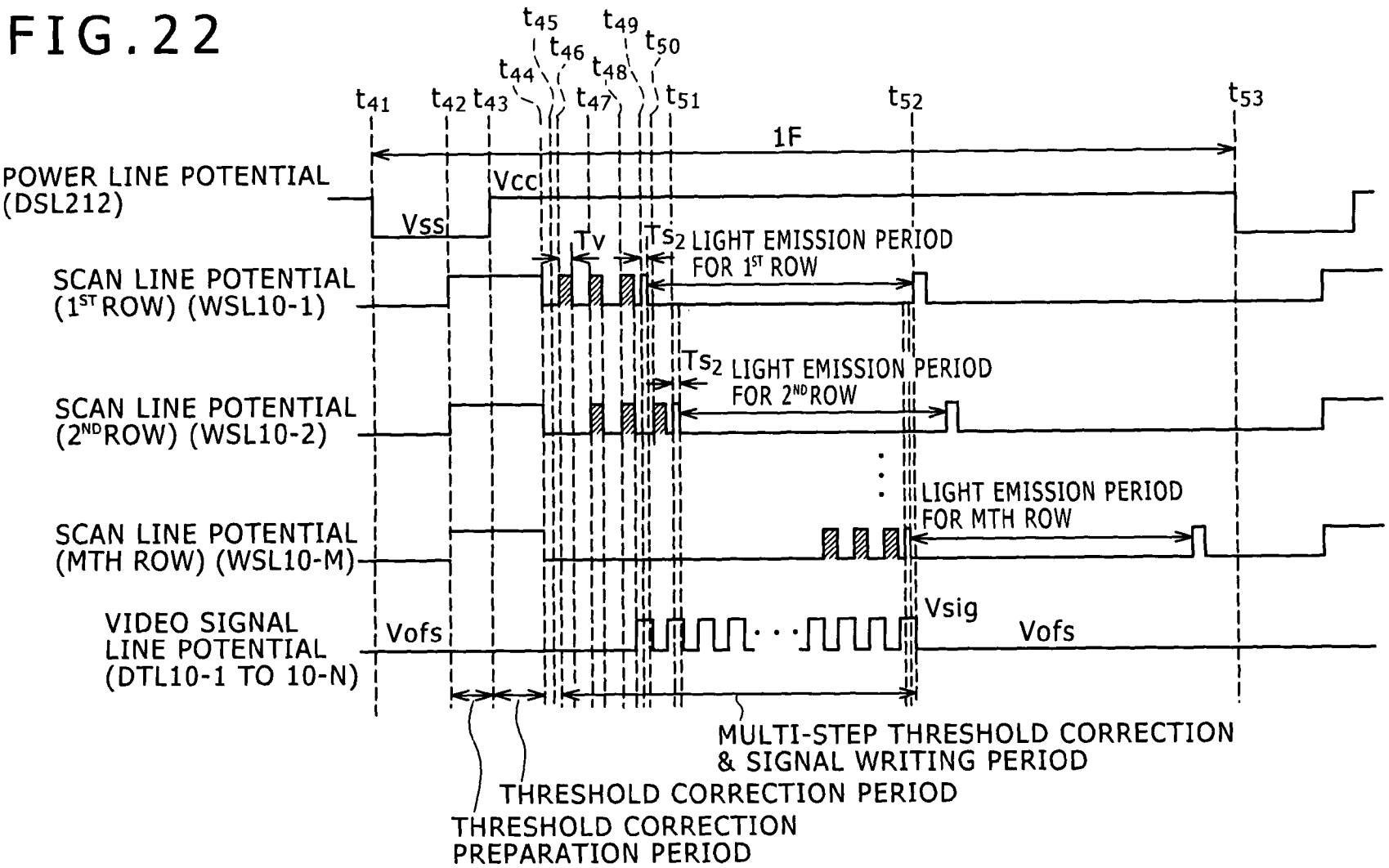
FIG. 22 is a timing diagram describing a third drive control method of the EL panel shown in FIG. 16.

The above first and second drive control methods change the video signal lines DTL10 from the reference potential Vofs to the second reference potential Vofs2 or Vofs2' before performing the row-by-row multi-step threshold correction. However, the method adapted to perform the row-by-row multi-step threshold correction and signal writing with the video signal lines DTL10 maintained at the reference potential Vofs (third drive control method) as illustrated in FIG. 22 also prevents uneven image quality for improved image quality. The third drive control method is similar to the first and second drive control methods in that the method ensures shorter time from the threshold correction to the video signal writing by performing the threshold correction immediately before the video signal writing. The third method is also similar to the first and second methods in that the time from the threshold correction to the video signal writing is constant between the different rows A description was given of examples in relation to the first to third drive control methods in which the row-by-row multi-step threshold correction was performed three times. However, the threshold correction need only be performed at least once.

Further, a description was given of examples in which the first threshold correction was performed on all the pixels (all the rows) of the pixel array section 102. Alternatively, however, the threshold correction may be performed on the pixels in two or more rows at a time. In this case, the power supply section 211 and power line DSL212 are configured to control the pixels in units of the number of rows on which the first threshold correction is performed at a time.

The present invention is not limited to the above embodiments but may be modified in various ways without departing from the scope of the present invention.

The present application contains subject matter related to that disclosed in Japanese Priority Patent Application JP 2008-159364, filed in the Japan Patent Office on Jun. 18, 2008, the entire content of which is hereby incorporated by reference.

What is claimed is:

1. A panel comprising a plurality of pixel circuits arranged in a matrix form, respective ones of the pixel circuits including:

a light-emitting element configured to emit light according to a drive current;

a sampling transistor configured to sample a video signal;

a drive transistor configured to supply the drive current to the light-emitting element; and a holding capacitor configured to hold a given potential, and power supply means for controlling a source voltage, supplied to the pixel circuits, simultaneously for the pixel circuits in two or more rows, wherein a threshold correction preparation and a first threshold correction are performed simultaneously on all the pixel circuits in two or more rows in units of which the pixel circuits are supplied the source voltage by the power supply means, and a second threshold correction is performed on the pixel circuits one row at a time once or more times in a line sequential manner.

2. The panel of claim 1 further comprising:

video signal supply means for supplying a signal potential, associated with a video signal, to the pixel circuits, wherein the video signal supply means can supply, during the second threshold correction, a higher potential than a reference potential supplied to the pixel circuits during the first threshold correction.

3. The panel of claim 1 further comprising:

video signal supply means for supplying a signal potential, associated with a video signal, to the pixel circuits, wherein the video signal supply means can supply, for a predetermined period of time after the first threshold correction, a lower potential than a reference potential supplied to the pixel circuits during the first threshold correction.

4. The panel of claim 1 further comprising:

scan control means for turning the sampling transistors of the pixel circuits on or off, wherein the light emission period of the light-emitting elements can be controlled by the scan control means by turning the sampling transistors of the pixel circuits on or off

5. The panel of claim 4, wherein when the sampling transistor is turned on by the scan control means to cause the light-emitting element to stop emitting light, the potential supplied to the gate of the drive transistor is equal to or smaller than the sum of a cathode potential and threshold voltage of the light-emitting element and a threshold voltage of the drive transistor.

6. The panel of claim 4, wherein when the sampling transistor is turned on by the scan control means to cause the light-emitting element to stop emitting light, the potential supplied to the gate of the drive transistor is the same as the reference potential for threshold correction.

7. A drive control method of a panel, the panel including a plurality of pixel circuits arranged in a matrix form, respective ones of the pixel circuits including:

a light-emitting element configured to emit light according to a drive current;

a sampling transistor configured to sample a video signal;

a drive transistor configured to supply the drive current to the light-emitting element; and a holding capacitor configured to hold a given potential, the panel further including power supply means for controlling a source voltage, supplied to the pixel circuits, simultaneously for the pixel circuits in two or more rows, the drive control method comprising the steps of performing a threshold correction preparation and a first threshold correction simultaneously on all the pixel circuits in two or more rows, and then performing a second threshold correction on the pixel circuits one row at a time once or more times in a line sequential manner.

8. The drive control method of the panel according to claim 7, further comprising:

supplying a signal potential, associated with a video signal, to the pixel circuits, and providing, during the second threshold correction, a higher potential than a reference potential supplied to the pixel circuits during the first threshold correction.

9. The drive control method of the panel according to claim 7, further comprising:

supplying a signal potential, associated with a video signal, to the pixel circuits, and providing, for a predetermined period of time after the first threshold correction, a lower potential than a reference potential supplied to the pixel circuits during the first threshold correction.

10. The drive control method of the panel according to claim 7, further comprising turning, by scan control means, the sampling transistors of the pixel circuits on or off, the turning including controlling the light emission period of the light-emitting elements.

11. The drive control method of the panel according to claim 10, further comprising:

turning the sampling transistor is on by the scan control means to cause the light-emitting element to stop emitting light, wherein the potential supplied to the gate of the drive transistor is equal to or smaller than the sum of a cathode potential and threshold voltage of the light-emitting element and a threshold voltage of the drive transistor.

12. The drive control method of the panel according to claim 10, further comprising turning the sampling transistor on by the scan control means to cause the light-emitting element to stop emitting light, wherein the potential supplied to the gate of the drive transistor is the same as the reference potential for threshold correction.

* * * * *